US012234660B2

(12) United States Patent
Wells

(10) Patent No.: US 12,234,660 B2
(45) Date of Patent: Feb. 25, 2025

(54) SYSTEM AND METHOD FOR A TEMPORARY PROTECTIVE STRUCTURE FOR USE IN CONSTRUCTION AND DEMOLITION

(71) Applicant: Simon Wells, Fort Lauderdale, FL (US)

(72) Inventor: Simon Wells, Fort Lauderdale, FL (US)

( * ) Notice: Subject to any disclaimer, the term of this patent is extended or adjusted under 35 U.S.C. 154(b) by 184 days.

(21) Appl. No.: 18/105,814

(22) Filed: Feb. 4, 2023

(65) Prior Publication Data

US 2024/0263469 A1 Aug. 8, 2024

(51) Int. Cl.
*E04G 21/32* (2006.01)

(52) U.S. Cl.
CPC ..... *E04G 21/3209* (2013.01)

(58) Field of Classification Search
CPC ..... E04G 21/30; E04G 21/3209; E04F 13/075
See application file for complete search history.

(56) References Cited

U.S. PATENT DOCUMENTS 3,895,981 A * 7/1975 Tesch ..... E04F 11/163 52/181
6,640,501 B1 * 11/2003 Hussey ..... E04G 21/30 52/177
6,996,860 B1 * 2/2006 Blake ..... A47K 3/001 4/504
7,228,668 B2 * 6/2007 Gibney ..... E04G 21/30 52/211
7,749,588 B2 * 7/2010 Blake ..... B32B 29/08 428/184
7,823,332 B2 * 11/2010 Siegel ..... A47G 27/0287 52/177
8,839,592 B2 * 9/2014 Foran ..... E04G 21/243 52/796.1
9,091,073 B2 * 7/2015 Wells ..... E04F 15/02
9,732,533 B2 * 8/2017 Ruzhin ..... E04G 21/30
9,945,137 B2 * 4/2018 Prest ..... E04G 21/30
9,956,568 B2 * 5/2018 O'Brien ..... B05C 21/005
10,570,623 B1 * 2/2020 Wells ..... E04F 11/17
10,676,939 B2 * 6/2020 Wells ..... E04G 21/30
10,731,339 B2 * 8/2020 Hauserman-Winder ..... E04B 2/7453
10,907,367 B2 * 2/2021 Dixon ..... E04G 1/18
11,002,028 B2 * 5/2021 Rus ..... E04G 21/30
11,149,452 B2 * 10/2021 Rus ..... E04G 21/30
11,293,193 B2 * 4/2022 Rus ..... E04F 11/163
11,486,156 B2 * 11/2022 Rus ..... E04F 11/163
11,634,918 B1 * 4/2023 McQuade ..... B05B 12/22 5/420

(Continued)

*Primary Examiner* — Rodney Mintz
(74) *Attorney, Agent, or Firm* — Melvin K. Silverman

(57) ABSTRACT

A system and method of a temporary protective structural system. The system includes a plurality of frame members. The frame members define a pair of opposing studs and integrated top plate. The system also includes noggings connecting the studs. Ceiling joists are also included. The combination creates at least one free-standing tunnel module. Vertical wall panels are secured to the exteriors of the free-standing tunnel modules, thereby vertically enclosing the free-standing tunnel modules. Horizontal ceiling panels are secured to an exterior ceiling area of the tunnel modules. Horizontal floor panels provide a protective surface for the floor. When constructed, the combination of elements and tunnel modules create a protective barrier for sensitive surfaces in a construction zone.

34 Claims, 18 Drawing Sheets

(56) References Cited

U.S. PATENT DOCUMENTS 11,814,854 B1* 11/2023 Wells ..... E04G 21/30
11,851,899 B1* 12/2023 Wells ..... E04G 21/3209
12,054,942 B2* 8/2024 Bickford ..... E04B 2/7411
12,091,871 B2* 9/2024 Wells ..... E04G 21/30
2003/0196387 A1* 10/2003 Hussey ..... E04G 21/30 52/3
2004/0261344 A1* 12/2004 Gibney ..... E04G 21/30 52/506.01
2004/0261346 A1* 12/2004 Gibney ..... E04G 21/30 52/506.01
2005/0223650 A1* 10/2005 Blake ..... E04G 21/30 52/3
2008/0066389 A1* 3/2008 Siegel ..... A47G 27/0287 52/3
2010/0255770 A1* 10/2010 Blake ..... B32B 3/12 454/367
2013/0236676 A1* 9/2013 Doyle ..... E04G 21/30 428/57
2014/0033642 A1* 2/2014 Foran ..... E04G 21/30 52/782.1
2014/0157712 A1* 6/2014 Wells ..... E04G 21/30 52/796.1
2015/0056401 A1* 2/2015 Farah ..... B32B 37/22 156/547
2016/0312484 A1* 10/2016 Ruzhin ..... E04G 21/30
2017/0183883 A1* 6/2017 Rus ..... E04G 21/30
2017/0189925 A1* 7/2017 O'Brien ..... B05C 21/005
2018/0347205 A1* 12/2018 Rus ..... E04F 11/166
2018/0347215 A1* 12/2018 Rus ..... E04G 21/30
2018/0347216 A1* 12/2018 Rus ..... E04F 11/104
2018/0353051 A1* 12/2018 Clark ..... A47L 13/10
2019/0085572 A1* 3/2019 Rus ..... E04G 21/30
2019/0186129 A1* 6/2019 Hauserman-Winder ..... E04B 2/7453
2020/0040585 A1* 2/2020 Wells ..... E04F 11/163
2020/0123781 A1* 4/2020 Wells ..... E04F 11/1045
2020/0141137 A1* 5/2020 Dixon ..... E04G 1/18
2020/0332543 A1* 10/2020 Rus ..... E04F 11/163
2021/0238845 A1* 8/2021 Bickford ..... B32B 9/041
2022/0178138 A1* 6/2022 Bickford ..... E04B 2/7448
2024/0263467 A1* 8/2024 Wells ..... E04G 21/243
2024/0263468 A1* 8/2024 Wells ..... E04G 21/30
2024/0337121 A1* 10/2024 Balbis Farinha ..... E04G 21/24

* cited by examiner

SYSTEM AND METHOD FOR A TEMPORARY PROTECTIVE STRUCTURE FOR USE IN CONSTRUCTION AND DEMOLITION

FIELD OF THE INVENTION

The present invention relates temporary structures used in construction and demolition.

BACKGROUND

When the interiors of Yachts and other high-end vehicles/crafts are being refitted, not all surfaces and interiors are demolished. Because these remaining high-end fixtures and surfaces are vulnerable to damage from debris and loose articles from demolition, it is important to include protections against such damage. While no solution exists in the marine industry, systems in general construction and building include scaffolding and plastic tarps, typically duct taped together to contain dust. However, this setup does not protect flooring, walls, and other surfaces from heavier debris, and damage can occur if something is dropped. Typically, builders may include cardboard squares on the floor, however these squares can slide and scrape the floors they're intended to protect. In addition, when leaving these protected areas, there is typically no protection for rooms being left unaltered. That is, the scaffolding, tarps, and cardboard only exist in the construction area.

When the interiors of Yachts and other high-end vehicles, crafts, buildings, and the like are being refitted, the rooms being demolished and remodeled are typically nestled down a maze of corridors and stairways. Thus, a need exists in the market for a temporary protective structure that is configurable to tunnel through unaltered areas of a structure under renovation and provide enhanced protection for the surfaces outside the tunnel so that damage does not occur.

SUMMARY OF THE INVENTION

The invention disclosed herein provides a temporary protective structural system. The system includes a plurality of frame members including at least a first frame member and at least a second frame member. In some embodiments, each frame member in the plurality of frame members is a unitary frame element comprising a pair of opposing studs and integrated top plate connecting the pair of opposing studs at an upper integration point. In other embodiments, each frame member in the plurality of frame members is comprised of an adjustable frame element including a pair of opposing studs and integrated two-part top plate connecting the pair of opposing studs at an upper integration point. The system also includes a plurality of noggings connecting a first stud of the pair of opposing studs of the first frame member in the plurality of frame members with a first stud of the pair of opposing studs of the second frame member in the plurality of frame members, and a plurality of noggings connecting a second stud of the pair of opposing studs of the first frame member in the plurality of frame members with a second stud of the pair of opposing studs of the second frame member in the plurality of frame members, thereby forming at least one free-standing tunnel module. A plurality of ceiling joists is also included, wherein the ceiling joists connect the top plate of each of the first frame members to a top plate of each of the second frame members, thereby securing the at least one free-standing tunnel module. At least one vertical wall panel is secured to an exterior area of the at least one free-standing tunnel module, thereby vertically enclosing the at least one free-standing tunnel module. At least one horizontal ceiling panel is secured to an exterior ceiling area of the at least one free-standing tunnel module. In addition, at least one horizontal floor panel is included, whereby the at least one horizontal ceiling panel and the at least one floor panel horizontally enclose the at least one free-standing tunnel module.

The invention disclosed herein also provides a temporary protective structural system with adjustable width is provided. The temporary protective structural system with adjustable width includes a plurality of frame members having at least a first frame member and second frame member, wherein each frame member in the plurality of frame members is comprised of an adjustable frame element including a pair of opposing studs and integrated two-part top plate connecting the pair of opposing studs at an upper integration point. The temporary protective structural system with adjustable width further includes a plurality of noggings connecting a first stud of the pair of opposing studs of the first frame member in the plurality of frame members with a first stud of the pair of opposing studs of the second frame member in the plurality of frame members, and a plurality of noggings connecting a second stud of the pair of opposing studs of the first frame member in the plurality of frame members with a second stud of the pair of opposing studs of the second frame member in the plurality of frame members, thereby forming at least one free-standing tunnel module. The temporary protective structural system with adjustable width further includes a plurality of ceiling joists connecting the two-part top plate of each of the first frame members to a two-part top plate of each of the second frame members, thereby securing the at least one free-standing tunnel module. The temporary protective structural system with adjustable width further includes at least one vertical wall panel secured to an exterior area of the at least one free-standing tunnel module, thereby vertically enclosing the at least one free-standing tunnel module. The temporary protective structural system with adjustable width further includes at least one horizontal ceiling panel secured to an exterior ceiling area of the at least one free-standing tunnel module, and at least one horizontal floor panel, whereby the at least one horizontal ceiling panel and the at least one floor panel horizontally enclose the at least one free-standing tunnel module.

The invention disclosed herein also provides a method of providing surface protection during at least construction and demolition is disclosed. The method of providing surface protection during at least construction and demolition comprises providing at least one horizontal floor panel, securing the at least one horizontal floor panel to a floor, providing a plurality of frame members including at least a first frame member and at least a second frame member, whereby the providing of the plurality of frame members further includes implementing a unitary frame construction comprising a pair of opposing studs and integrating a top plate connecting the pair of opposing studs at an upper integration point. The method of providing surface protection during at least construction and demolition further comprises providing a plurality of noggings and configuring the plurality of noggins to form at least one free-standing tunnel module when in combination with the plurality of frame members. The method of providing surface protection during at least construction and demolition further includes securing the at least one free-standing tunnel module by providing a plurality of ceiling joists, whereby the securing of the at least one free-standing tunnel module further comprises connecting the top plate of each of the first frame members to a top plate of each of the second frame members, thereby securing the at least one free-standing tunnel module. The method of providing surface protection during at least construction and demolition further includes enclosing the at least one free-standing tunnel module by providing at least one vertical wall panel and securing the at least one vertical wall panel to the at least one free-standing tunnel module, thereby vertically enclosing the at least one free-standing tunnel module, and securing at least one horizontal ceiling panel to a ceiling area of the at least one free-standing tunnel module.

It is an object of the present invention to provide a system capable of being readily assembled and disassembled with minimal pieces outside the overall system.

It is yet another object of the present invention is to provide a modular system that can be used to create a protective tunnel from a demolition or construction area to the outside of the structure where the threat of damage is no longer present.

It is a further object to provide a system that incorporates cushioned material to shield exposed surfaces of the structure.

The drawings and specific descriptions of the drawings, as well as any specific or alternative embodiments discussed, are intended to be read in conjunction with the entirety of this disclosure. The invention may be embodied in many different forms and should not be construed as being limited to the embodiments set forth herein; rather, these embodiments are provided by way of illustration only and so that this disclosure will be thorough, complete and fully convey understanding to those skilled in the art. The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

The invention herein provides a solution for protecting and maintaining the safety and integrity of unaltered fixtures and surfaces during demolition and construction. The invention includes a uniquely configured frame element with members connecting several frame elements to create a frame skeleton. Several protective panels surrounding the skeletal frame are incorporated to provide for protection and containment. This unique arrangement, in combination, is capable of solving the above issues plaguing current methods of protection during construction.

As stated above, when the interiors of Yachts and other high-end vehicles/crafts are being refitted, not all surfaces and interiors are demolished. Because these remaining high-end fixtures and surfaces are vulnerable to damage from debris and loose articles from demolition, it is important to include protections against such damage. While no solution exists in the marine industry, systems in general construction and building include scaffolding and plastic tarps, typically duct taped together to contain dust. However, this setup does not protect flooring, walls, and other surfaces from heavier debris, and damage can occur if something is dropped. Typically, builders may include cardboard squares on the floor, however these squares can slide and scrape the floors they're intended to protect. In addition, when leaving these protected areas, there is typically no protection for rooms being left unaltered. That is, the scaffolding, tarps, and cardboard only exist in the construction area.

When the interiors of Yachts and other high-end vehicles/crafts are being refitted, the rooms being demolished and remodeled are typically nestled down a maze of corridors and stairways. Thus, a need exists in the market for a temporary protective structure that is configurable to tunnel through unaltered areas of a vehicle or craft under renovation and provide enhanced protection for the surfaces outside the tunnel so that damage does not occur.

The current invention solves these problems by implementing a post 104 and beam 106 system with interconnecting members 108/110 for the skeletal frame and accompanying protective panels 112/114/116/118. The combination of these elements creates modules 120, which can be linked end to end to create a tunnel system capable of protecting sensitive surfaces.

Figure 1:
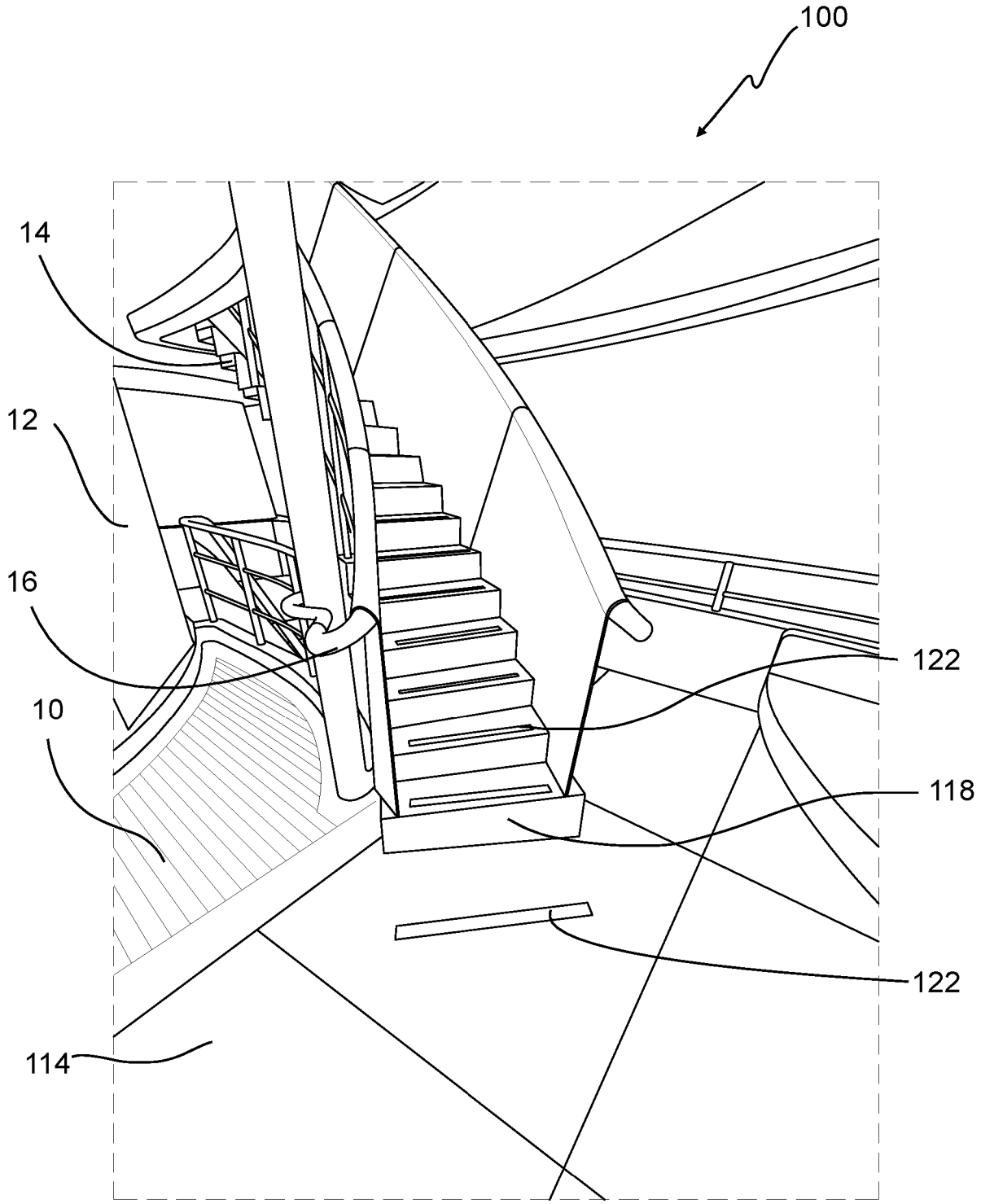
FIG. 1 illustrates a conceptual view of the protective product covering a stairwell of a marine craft.
Figure 18:
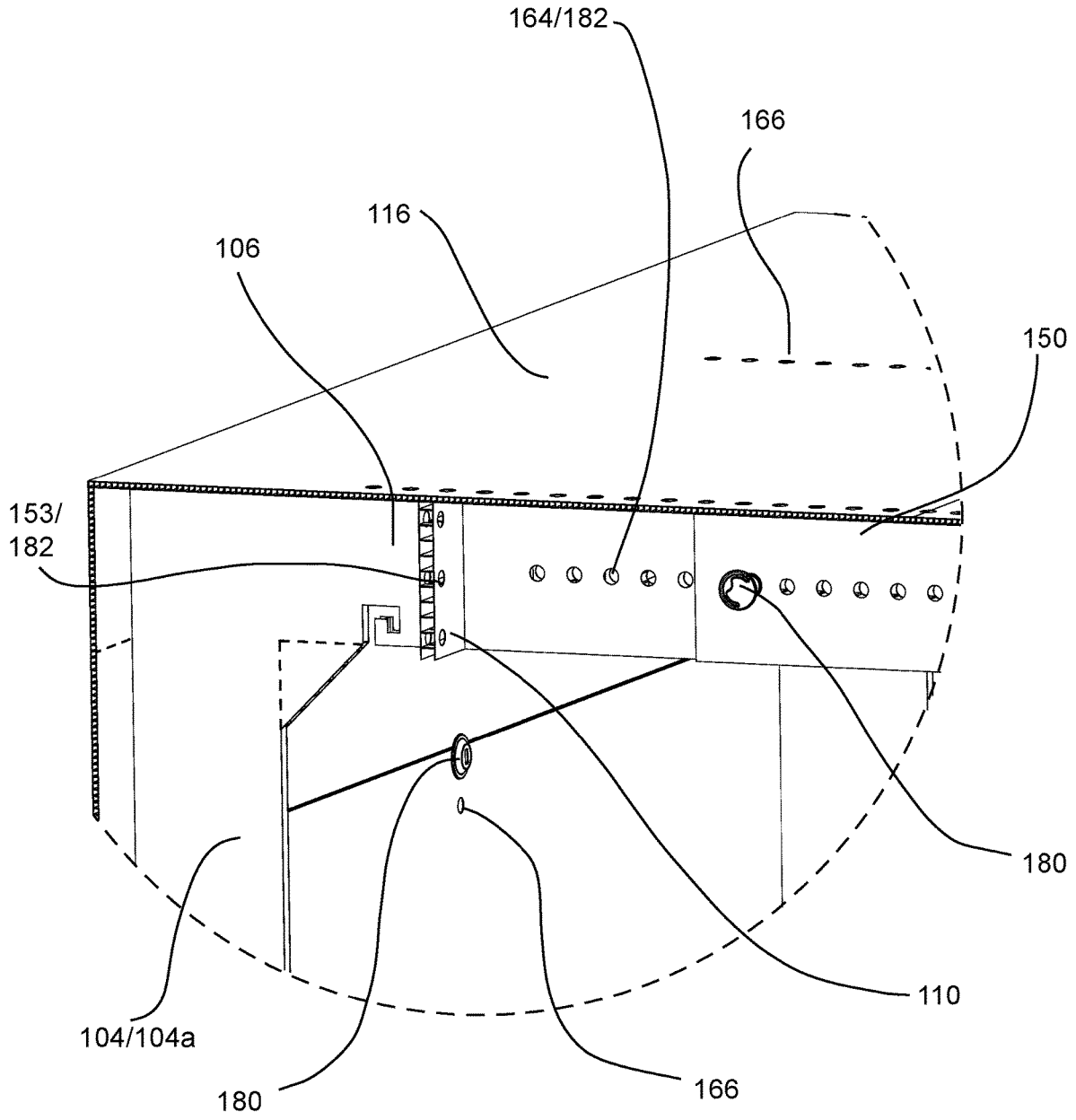
FIG. 18 illustrates an enlarged isometric view of the fastening and mechanics of an embodiment of the tunnel module.
Figure 19:
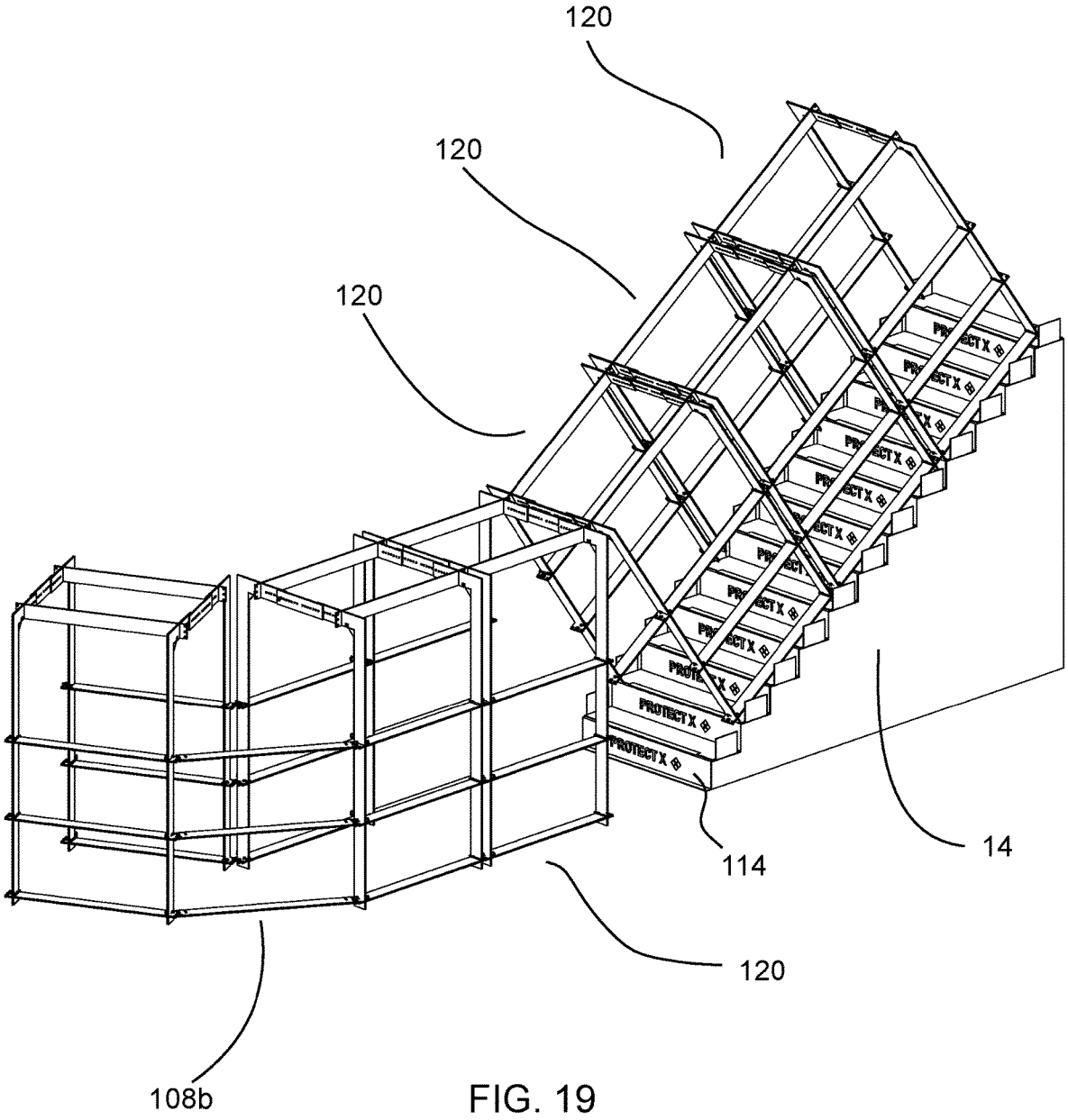
FIG. 19 illustrates an isometric view of the skeletal structure of multiple tunnel modules, including application on curves and inclines.

The system incorporates numerous features to protect the surfaces of the location under renovation. It begins with incorporation of linear protective sheets 112/114/116/118 to cover at least the flooring 10, as well as sensitive areas like walls 12, stairs 14, and railings 16, as shown in FIGS. 1 and 19. These protective sheets are constructed of a plastic material, and arranged with a first upper plastic surface, and a lower plastic surface, connected by plastic fluting thereby providing depth and cushion. The fluting may be appreciated from enlarged views in FIGS. 10-13, 15-16, and 18. The sheets are typically square or rectangular sheets with a linear slice through the first upper plastic sheet and the fluting to allow foldability. However, such sheets may also be cut to size and shape for unique applications. As the sheets are placed around, they are secured to the protected surface by an adhesive. Further, the sheets are then secured to each other by implementing an adhesive tape. Because the sheets are constructed of a plastic material, the incorporation of an adhesive tape creates a water-resistant surface. In addition, are areas of potential slippage, such as stair treads, an adhesive grip is used.

Figure 2:
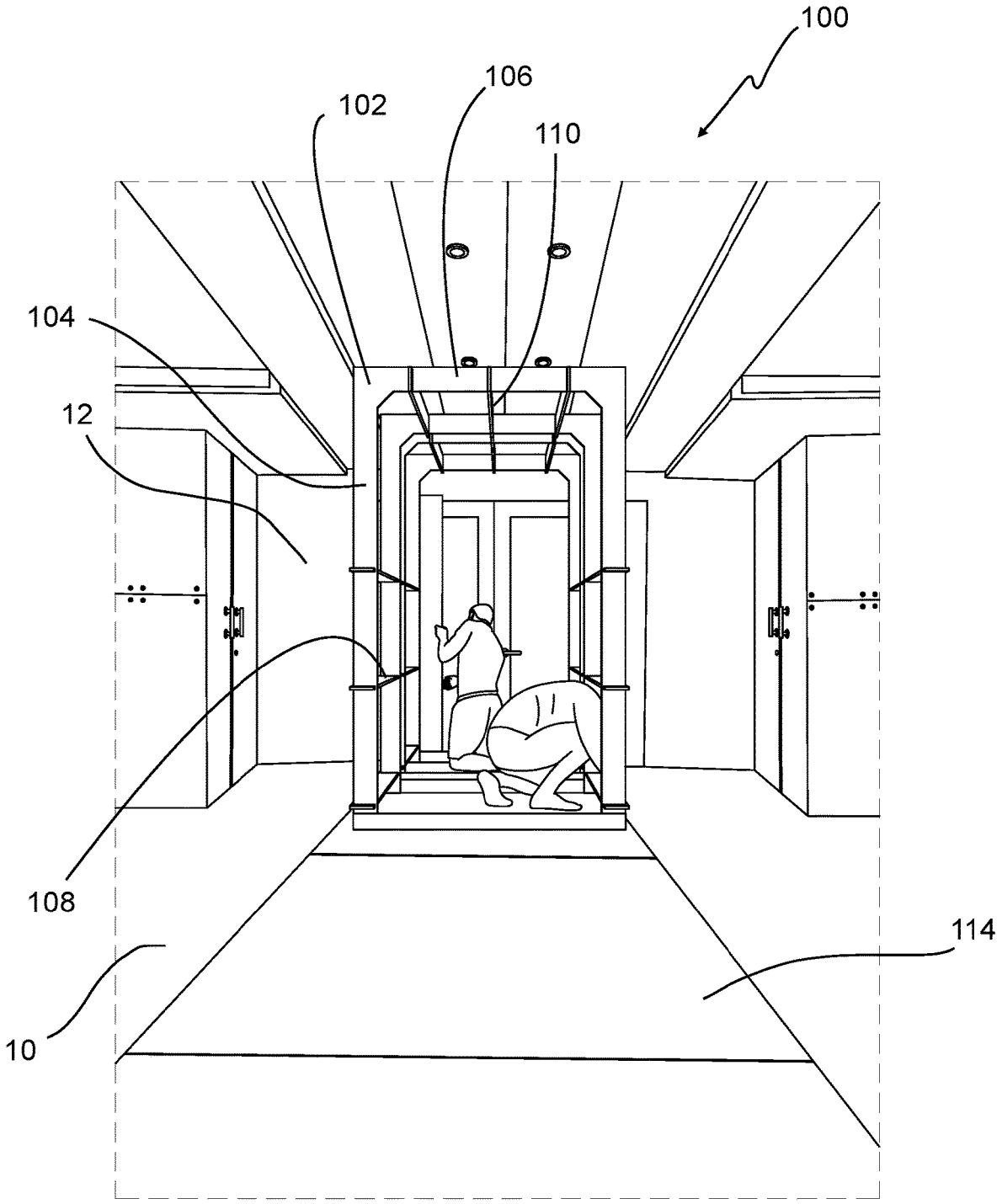
FIG. 2 illustrates a conceptual view of the product being installed in a room of a marine craft.
Figure 3:
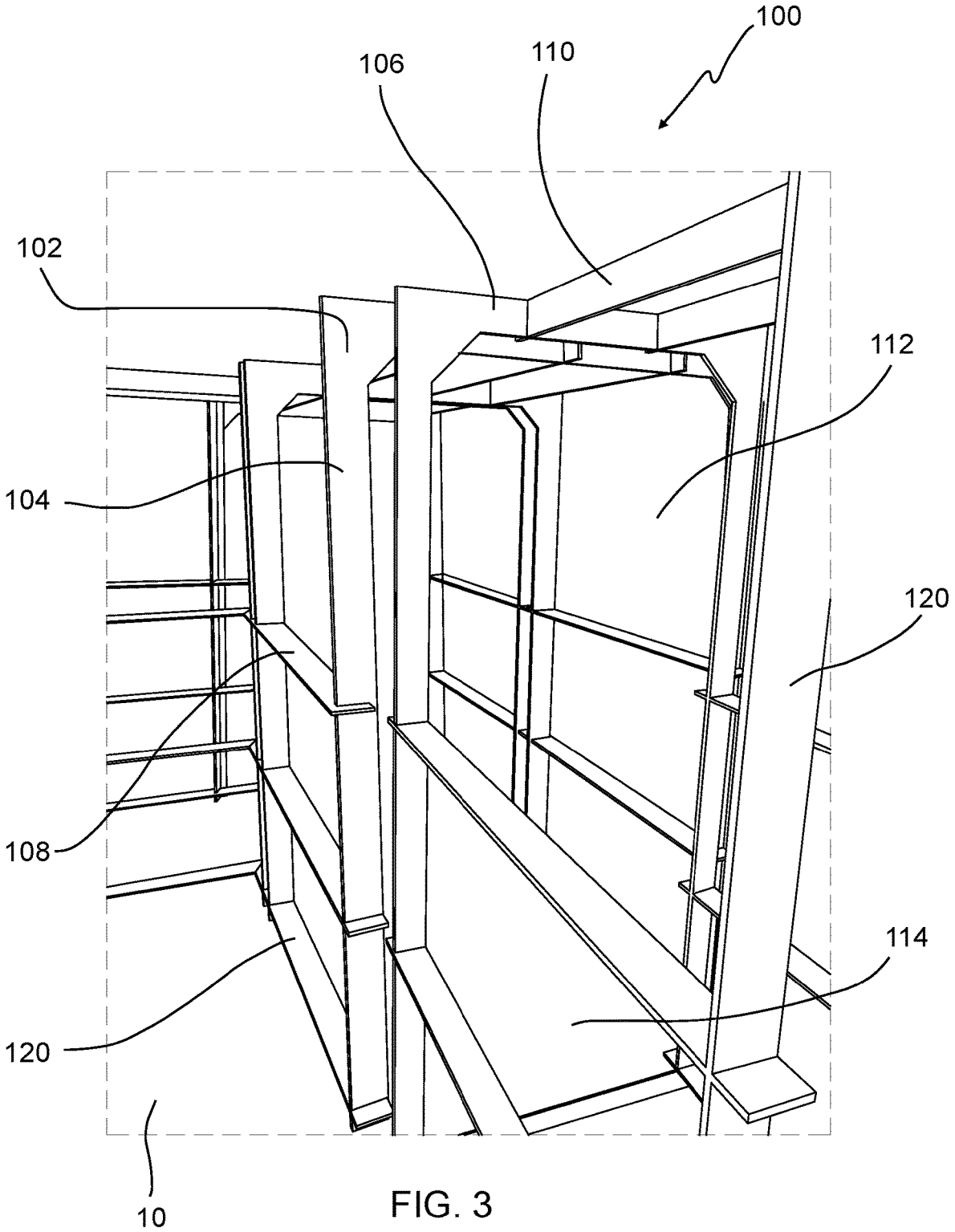
FIG. 3 illustrates a conceptual view of an assembled frame of the product installed in a room of a marine craft.

Once the protective sheets are in place, a skeletal frame may be constructed for the tunnel element of the system, as shown in FIGS. 2, 3, and 19. As may be seen, the frame incorporates a unitary U-shaped frame element 102 of fluted plastic material to keep the frames light and durable. It is important not to use any heavy materials so as to not pose a thread of damage to the underlying floorspace 10. The U-shaped frame element 102 includes vertical members 104, typically called studs 104 in frame construction, and an upper connecting member 106, known as a top plate 106 in frame construction. The frame 102 includes notches for integrating with other members of the system to provide an easily constructable and de-constructable temporary structure. The U-shaped frame elements 102 are connected to one another by horizontal members 108, typically called noggins 108 and a plurality of upper horizontal members 110, typically called ceiling joists 110. Each component is constructed of the same fluted plastic material for durability and lightness.

The U-shaped frame elements 102, noggins 108, and ceiling joists 110 all connect through complemental notches cut into each component. Once pressed into place, the elements for a tunnel module 120. Footings 134 may also be used to help the modules stand independently. These tunnels are modular and may be arranged in series to provide a continuous tunnel from a starting point inside a construction zone, to an end point beyond areas at risk of damage.

Figure 4:
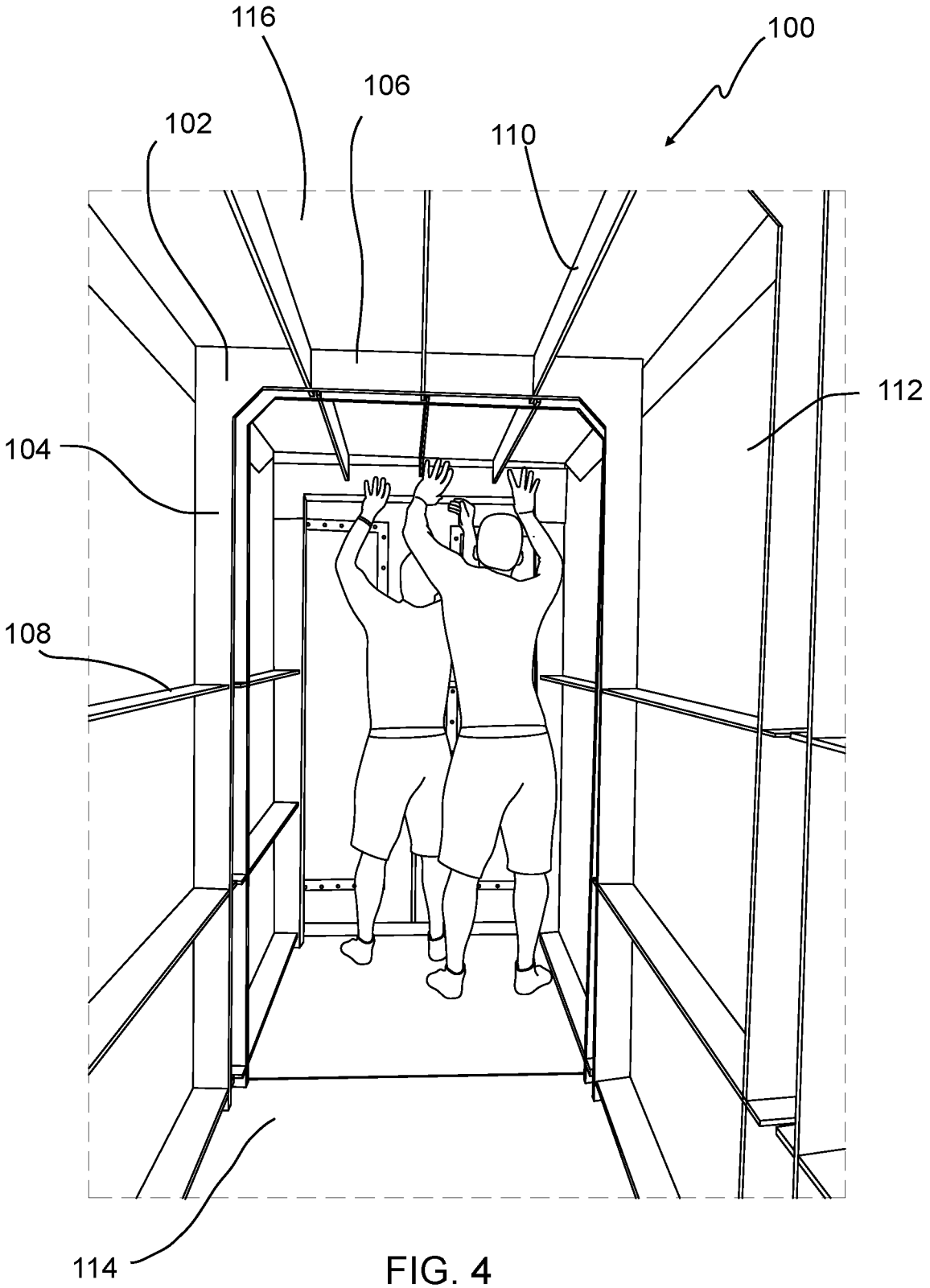
FIG. 4 illustrates a conceptual view of the product being installed in a room of a marine craft.

Panels 112/114/116 may be installed enclosing the modular tunnel frames once the tunnel frames are secured, as shown in FIG. 4. These panels 112/114/116 provide containment of the contents flowing through the tunnels, and are secured together with adhesive tape so that the tunnels are self-contained. It is to be appreciated that the sheets on the floor 114, panels forming the ceiling 116, and panels forming the wall 112 may all the same, thereby reducing the unique number of parts to ensure maximum flexibility and quickness of construction. These panels/sheets 112/114/116 are all constructed of fluted plastic material 156, as shown in FIGS. 10-13, 15-16, and 18. The fluting ensures cushion to falling objects, while the use of plastic allows the sheets/panels to elastically resume their shape, provide an impermeable water-resistant surface, and are lightweight to provide for ease of construction and avoid potential damage to the floor surface below. By incorporating an adhesive material 162 on each sheet, the sheets can affix to different surfaces, frames, and floors without the explicit need for adhesive tape. This ensures that the sheets/panels do not shift or slip. This aspect offers a significant benefit during construction because panels are not moving while they remain unsecured, and offers a significant benefit for surfaces because they remain in place while the tunnels are in use.

Figure 5:
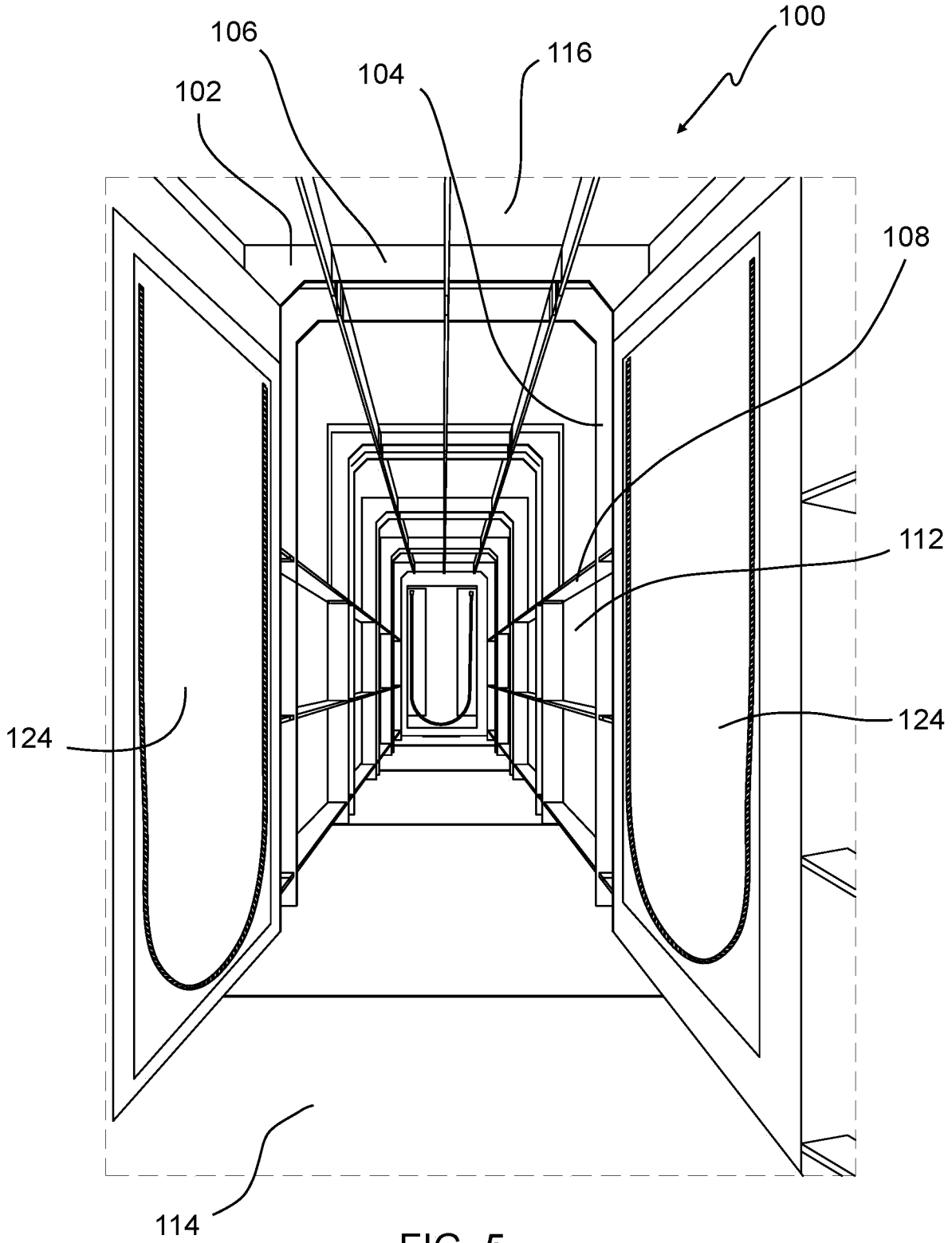
FIG. 5 illustrates a conceptual view of the product installed in a room of a marine craft.

On final construction shown in FIG. 5, the tunnels are sealed off with adhesive tape 160, and may incorporate plastic zipper doors 124, thereby sealing the tunnel off from unprotected areas of the construction zone and non-construction zone. Further, junctions of tunnels may be formed as well. Junctions may be sealed off with adhesive tape, and may be open on the inside, or may also contain plastic zipper doors 124 separating individual hallways within the tunnel system.

The system and method for a temporary protective structure for use in construction and demolition of the present invention may be used to provide a system capable of being readily assembled and disassembled with minimal pieces outside the overall system, provide a modular system that can be used to create a protective tunnel from a demolition or construction area to the outside of the structure where the threat of damage is no longer present, and provide a system that incorporates cushioned material to shield exposed surfaces of the structure. This apparatus and system are particularly shown in FIGS. 2-8, 17, and 18.

Figures 6, 7:
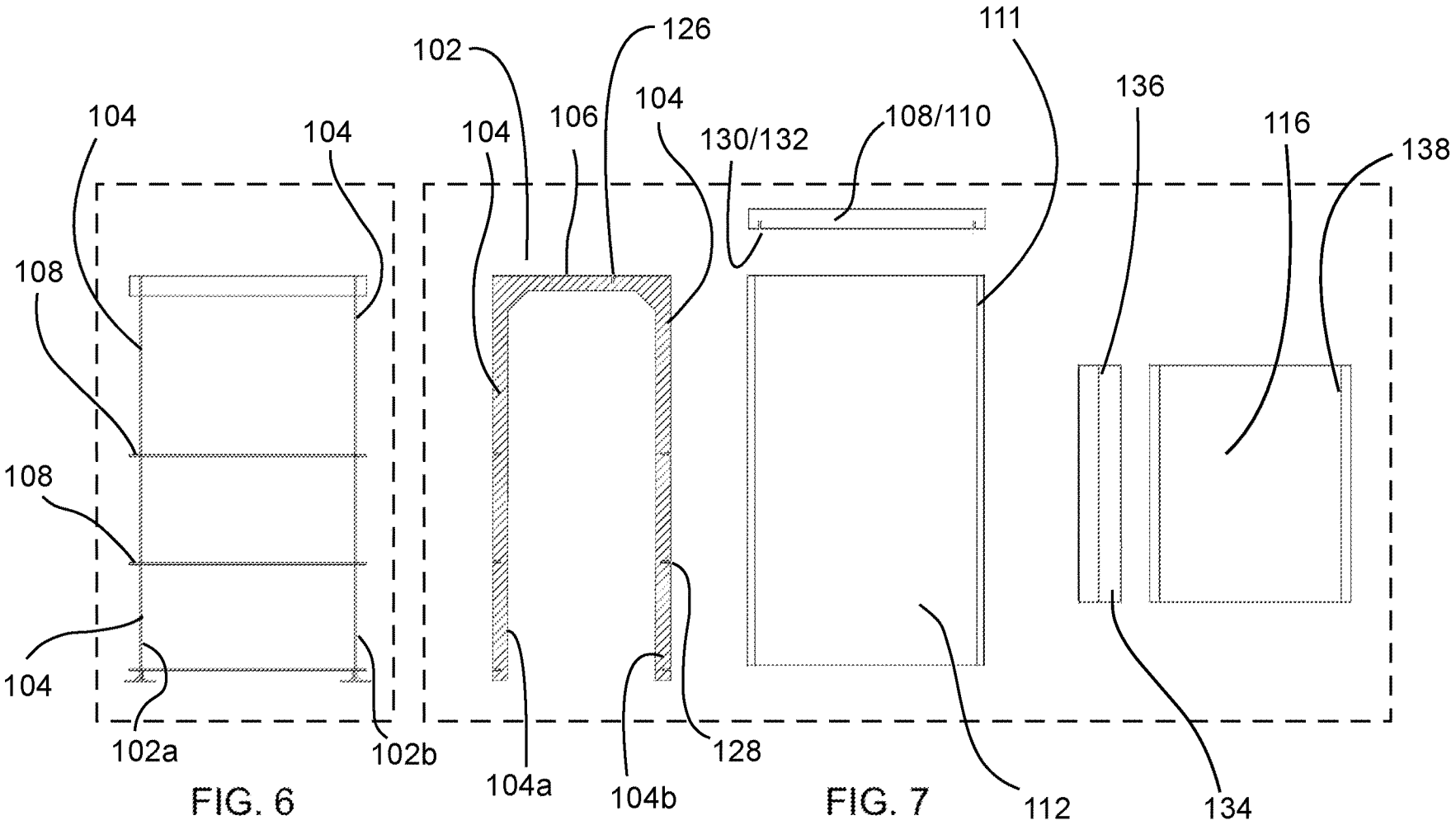
FIG. 6 illustrates a side elevation view of the skeleton of the tunnel module.
FIG. 7 illustrates two-dimensional views of various elements of the tunnel system.
Figure 8:
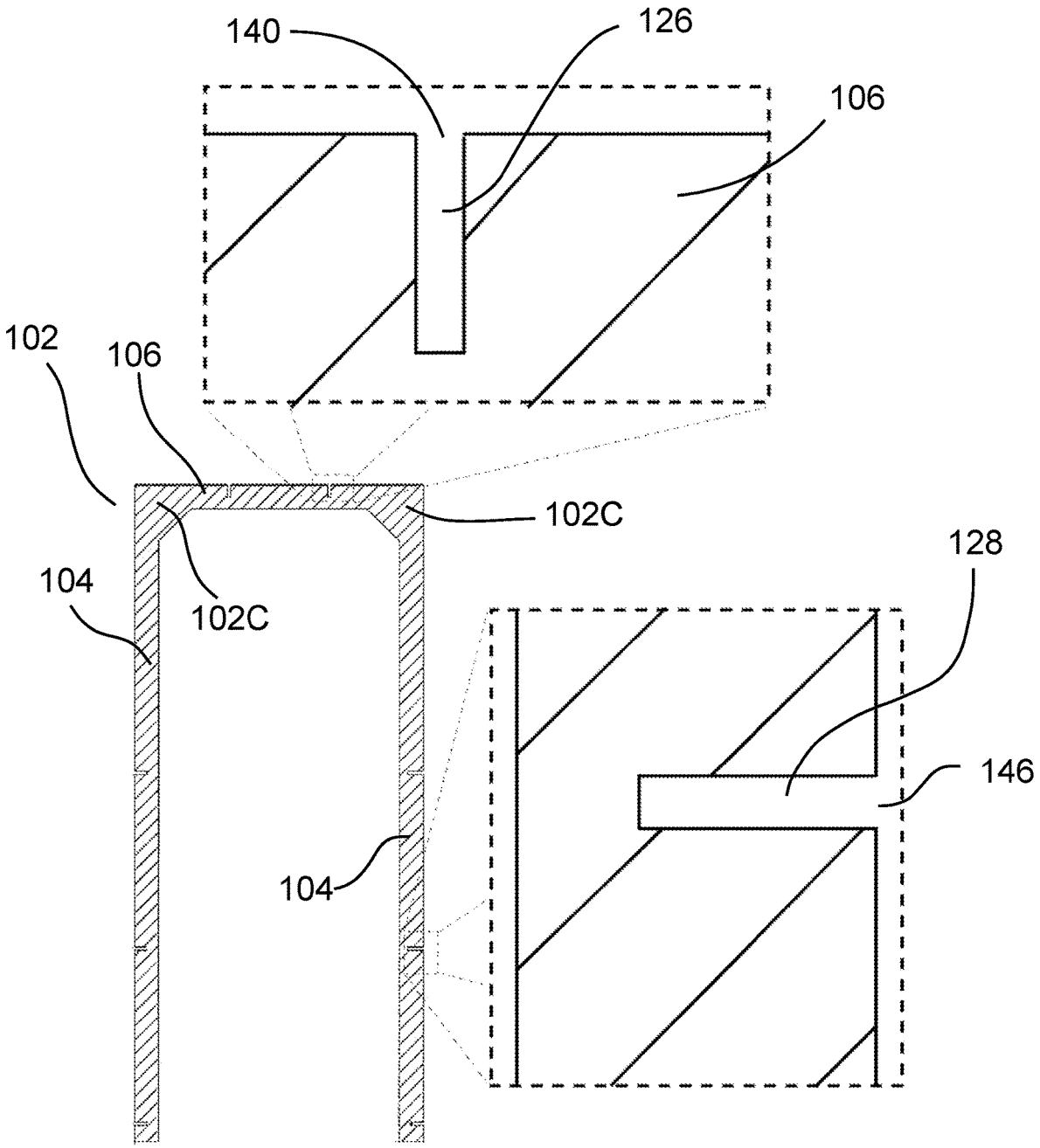
FIG. 8 illustrates enlarged portions of the frame element as shown in FIG. 7.
Figure 9:
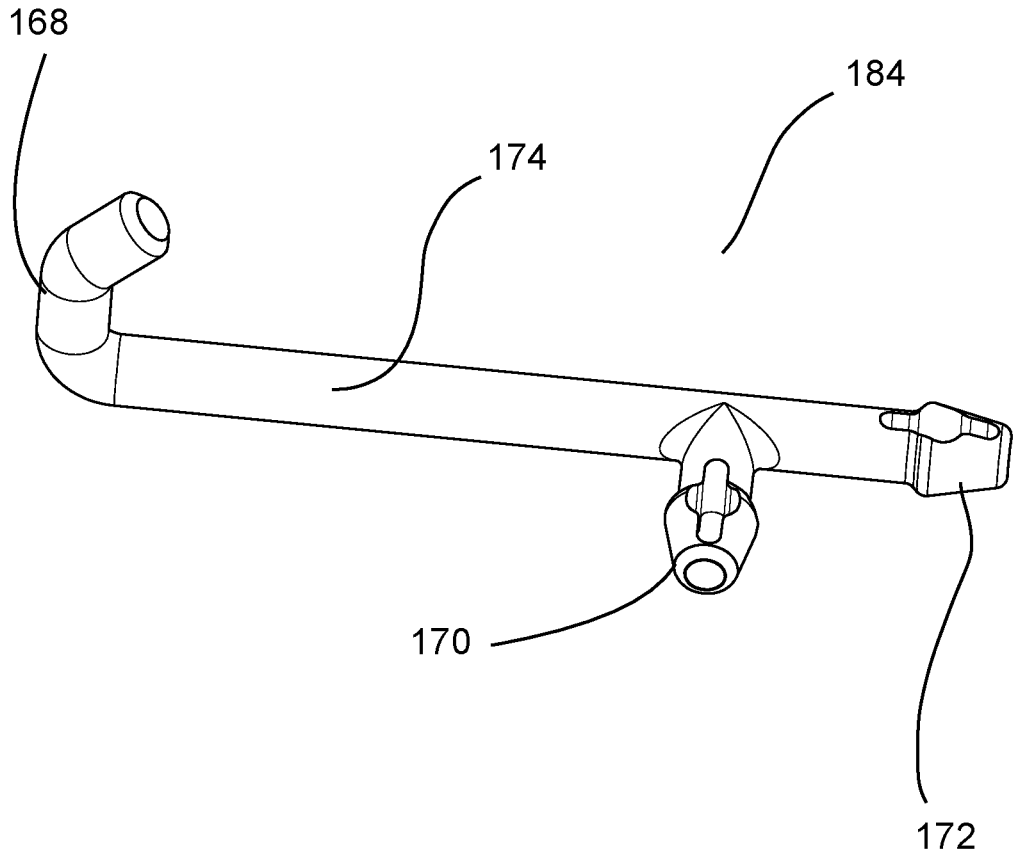
FIG. 9 illustrates an isometric view of the securement anchor.
Figure 11:
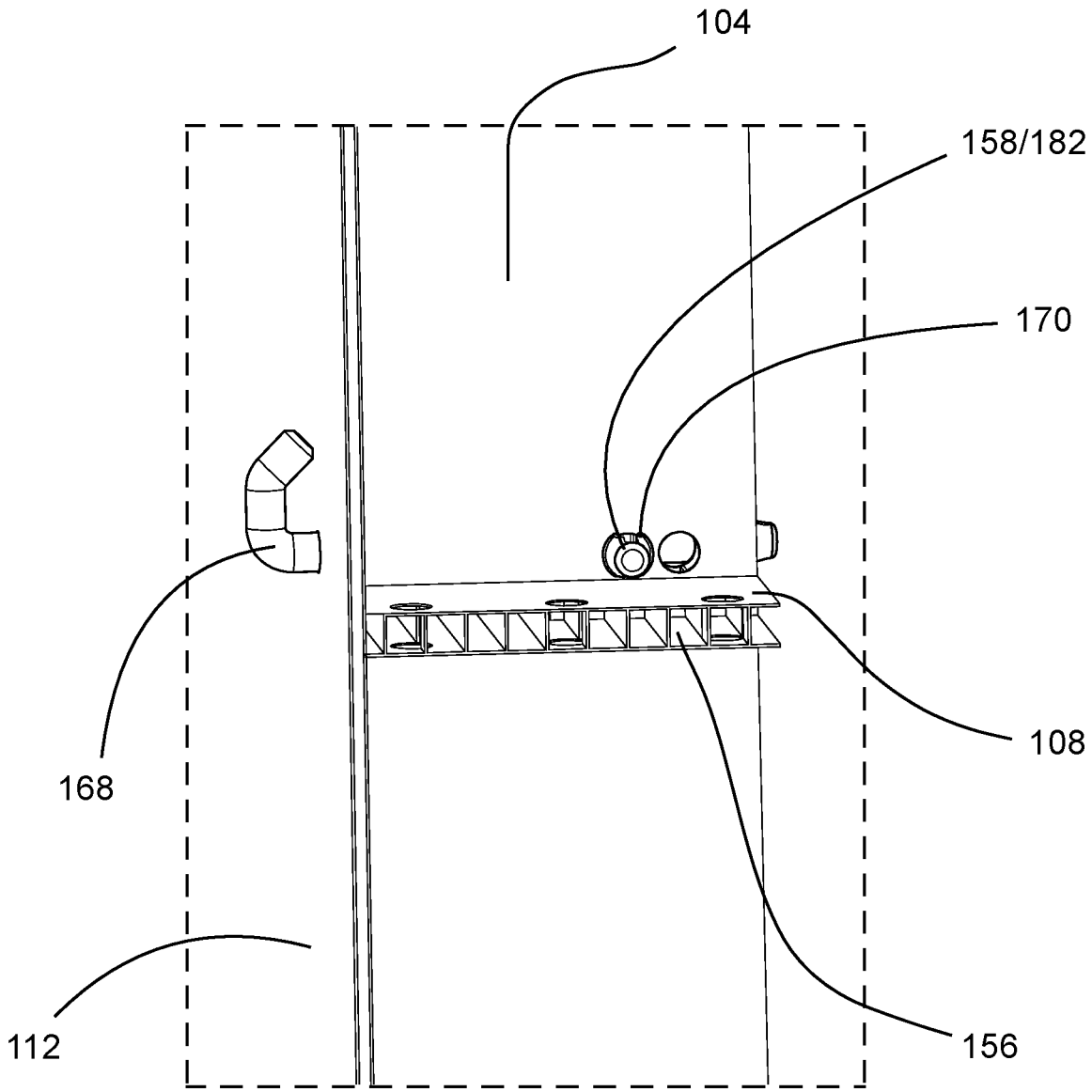
Figure 12:
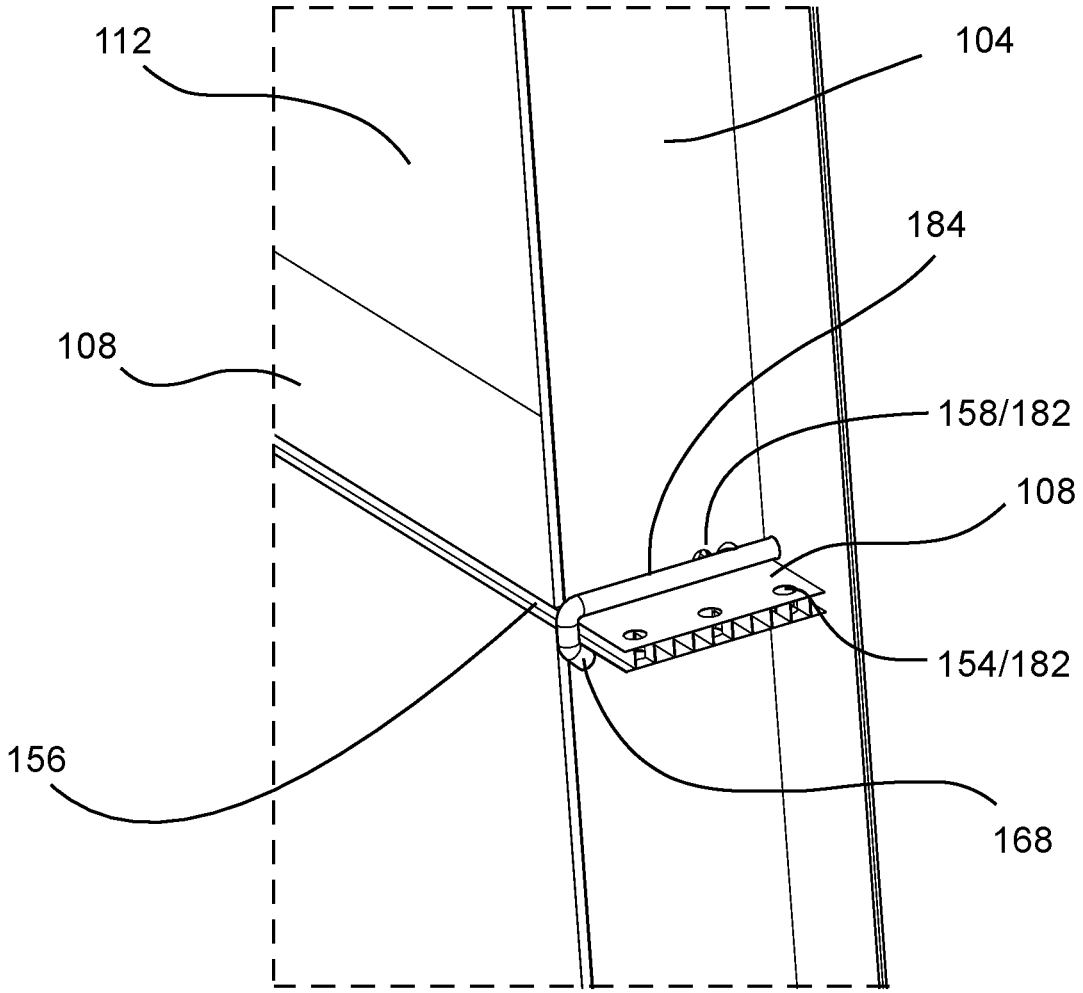
Figure 13:
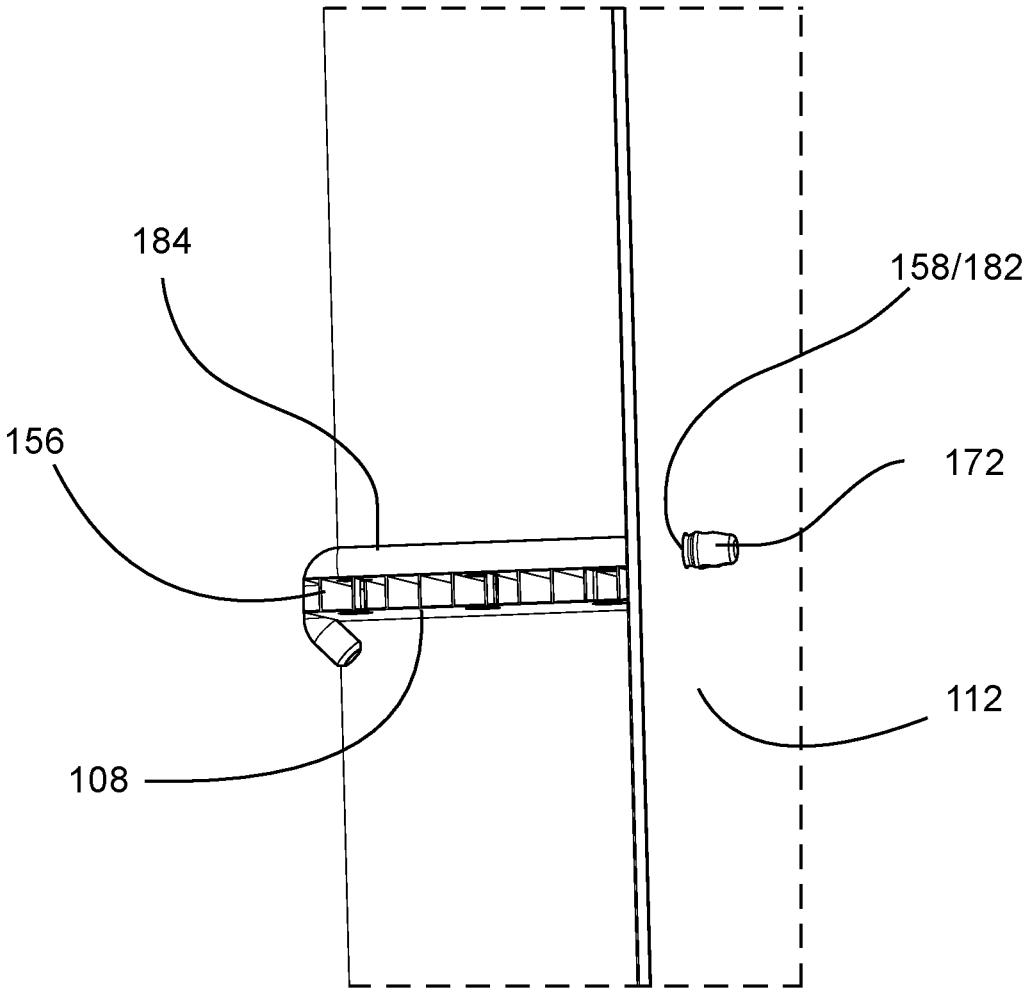
Figure 14:
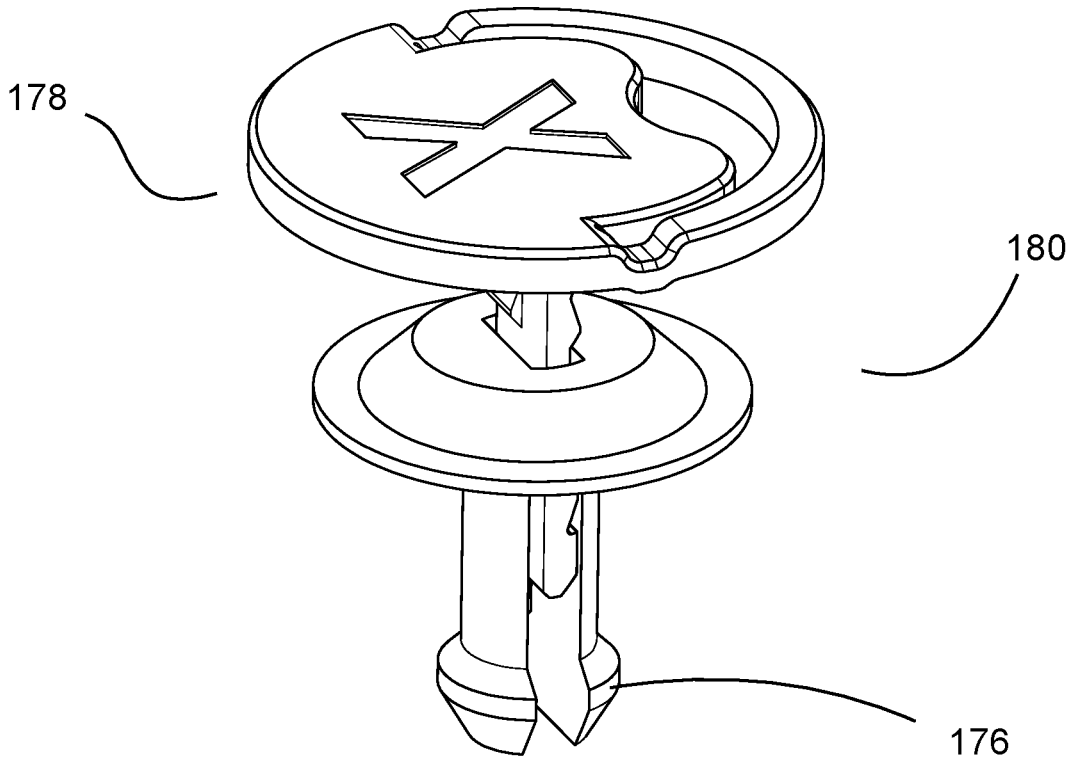
FIG. 14 illustrates an isometric view of the securement peg.
Figure 15:
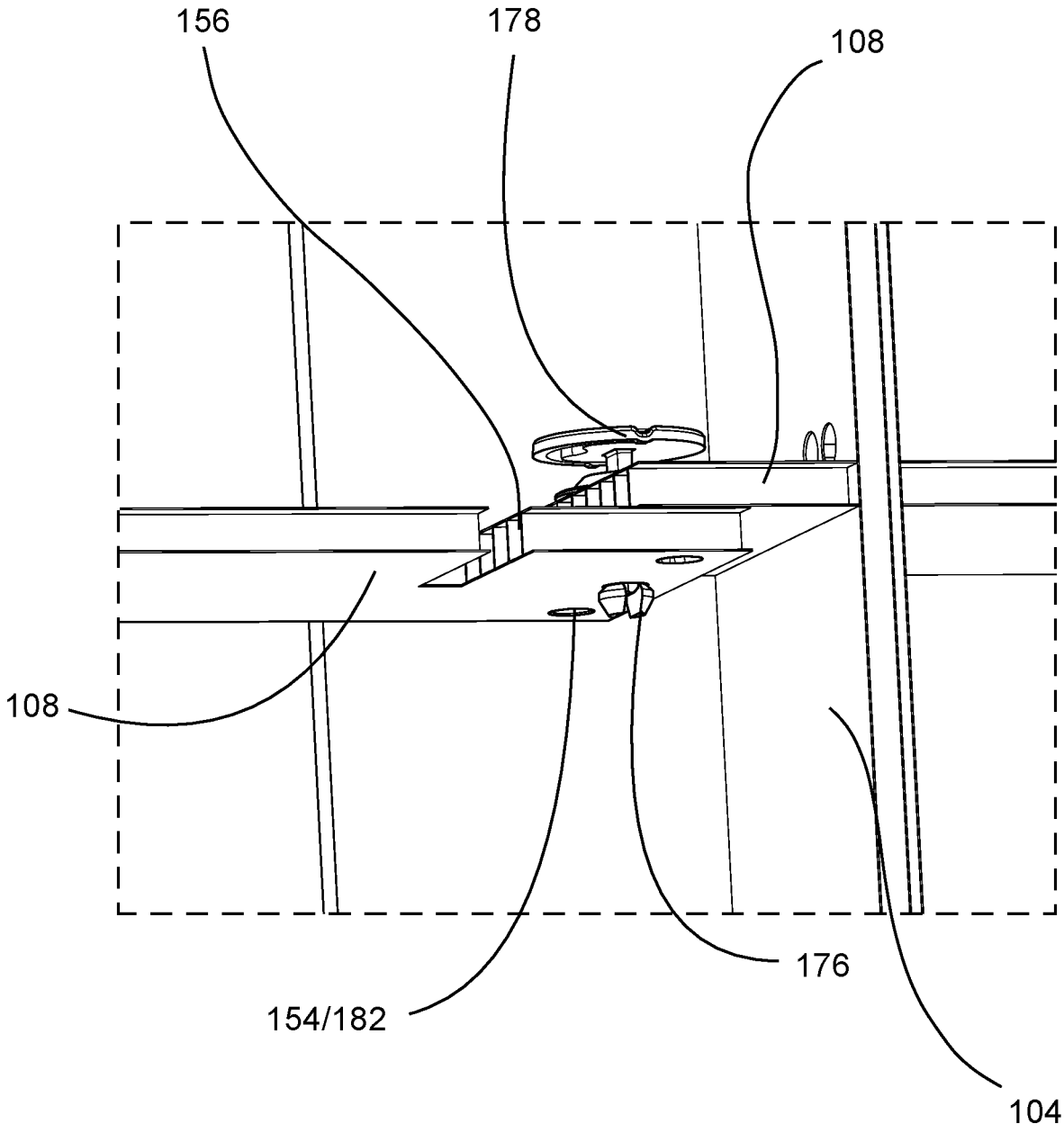
FIGS. 15 and 16 illustrate various isometric views of the engagement of the securement peg.
Figure 16:
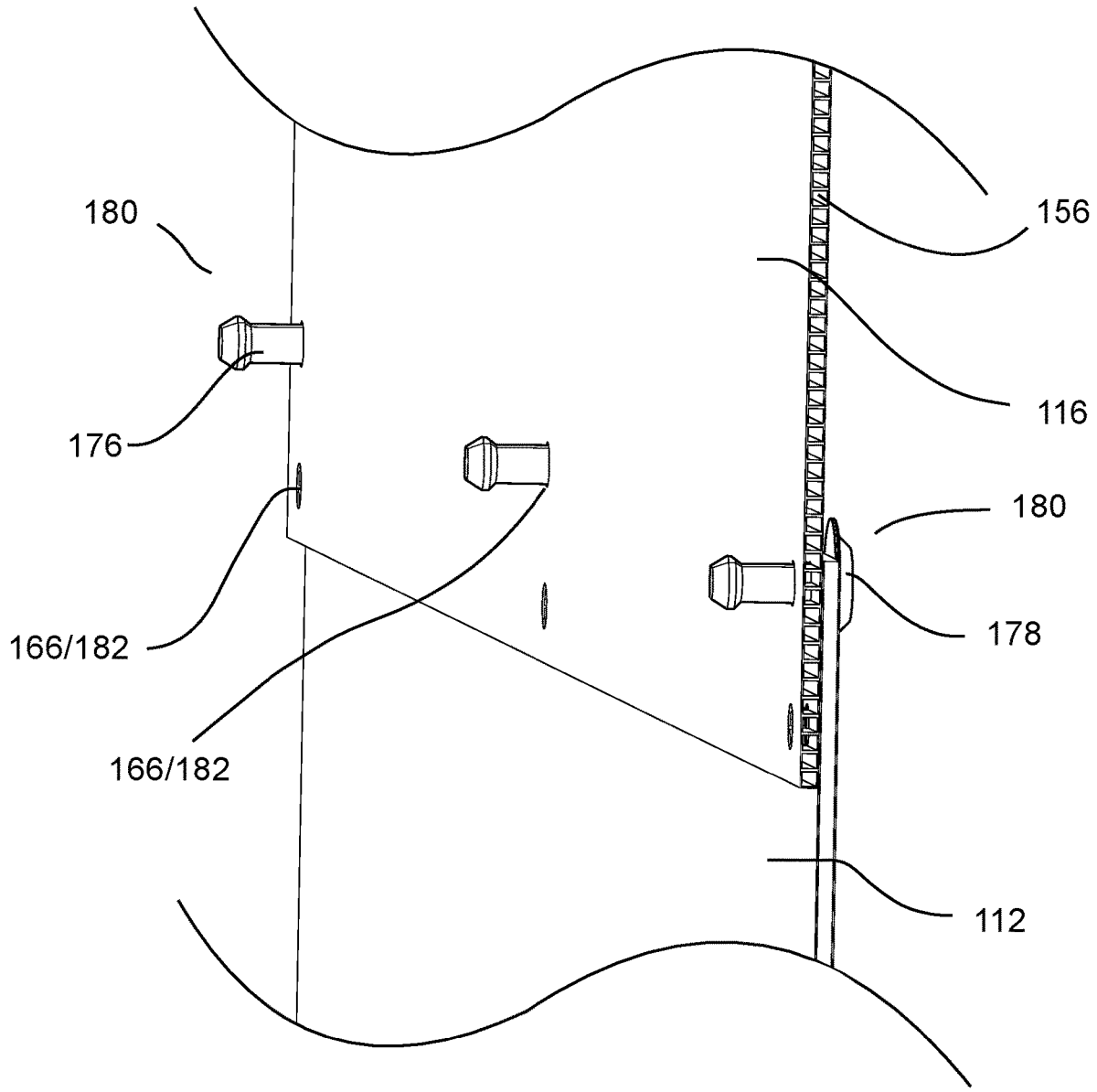
Figure 17:
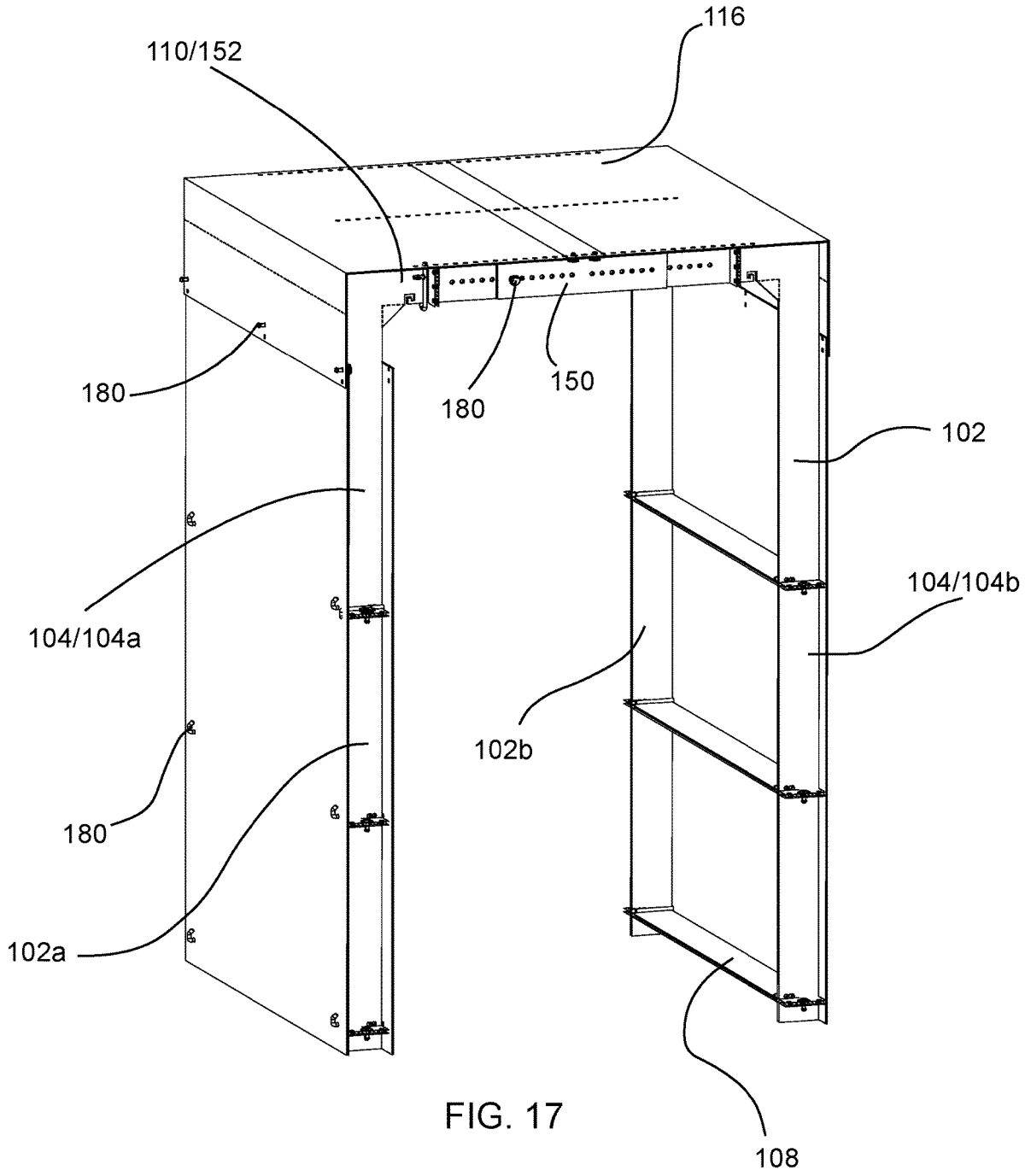
FIG. 17 illustrates an isometric view of an embodiment of the tunnel module.

FIG. 1 illustrates a conceptual view of the protective product 100 covering a stairwell 14 of a marine craft. FIG. 2 illustrates a conceptual view of the product 100 being installed in a room of a marine craft. FIG. 3 illustrates a conceptual view of an assembled frame, tunnel module 120, of the product 100 installed in a room of a marine craft. FIG. 4 illustrates a conceptual view of the product 100 being installed in a room of a marine craft. FIG. 5 illustrates a conceptual view of the product 100 installed in a room of a marine craft. FIG. 6 illustrates a side elevation view of the skeleton of the tunnel module, with the first frame member 102*a* and a second frame member 102*b*. FIG. 7 illustrates two-dimensional views of various elements of the tunnel system. FIG. 8 illustrates enlarged portions of the frame element 102 shown in FIG. 7. FIG. 9 illustrates an isometric view of the securement anchor 184. FIGS. 11-13 illustrates various isometric views of the engagement of the securement anchor 184. FIG. 14 illustrates an isometric view of the securement peg 180 including the cap 178 and stem 176. FIGS. 15 and 16 illustrate various isometric views of the engagement of the securement peg with cap 178 shown above the aperture, and stem 176 below the aperture, thereby coupling two noggins 108, as well as the coupling of a ceiling panel 116 and a wall panel 112 by the same mechanics. FIG. 17 illustrates an isometric view of an embodiment of the tunnel module. FIG. 18 illustrates an enlarged isometric view of the fastening and mechanics of an embodiment of the tunnel module. FIG. 19 illustrates an isometric view of the skeletal structure of multiple tunnel modules 120, including application on curves and inclines.

In an exemplary embodiment, a temporary protective structural system 100 is provided. The temporary protective structure 100 includes plurality of frame members 102 including at least a first frame member 102*a* and at least a second frame member 102*b*. Each frame member 102 in the plurality of frame members is a unitary frame element comprising a pair of opposing studs 104/104*a*/104*b* and integrated top plate 106 connecting said pair of opposing studs 104*a*/104*b* at an upper integration point 102*c*, as shown in FIGS. 7 and 8. As may be appreciated, this unitary construction allows for easy installation, whereby only a single frame element 102 need be provided. In some embodiments, the frame 102 may be split in to two pieces to allow adjustability widthwise, however, the principles remain the same in either orientation.

The temporary protective structure 100 also includes a plurality of noggings 108 connecting a first stud 104*a* of the pair of opposing studs 104*a*/104*b* of the first frame member 102*a* in the plurality of frame members 102 with a first stud 104*a* of the pair of opposing studs 104*a*/104*b* of the second frame member 102*b* in the plurality of frame members 102, as may be appreciated in FIG. 6, and applying the elements shown in FIG. 7. The temporary protective structure 100 also includes a plurality of noggings 108 connecting a second stud 104*b* of the pair of opposing studs 104*a*/104*b* of the first frame member 102*a* in the plurality of frame members 102 with a second stud 104*b* of the pair of opposing studs 104*a*/104*b* of the second frame member

102*b* in the plurality of frame members 102, thereby forming at least one free-standing tunnel module 120 as shown in in FIGS. 2-8, 17, and 18.

The temporary protective structure 100 also includes a plurality of ceiling joists 110 connecting the top plate 106 of each of the first frame members 102*a* to a top plate 106 of each of the second frame members 102*b*, thereby securing the at least one free-standing tunnel module 120.

To enclose the temporary protective structure 100, at least one vertical wall panel 112 is secured to an exterior area, as shown in FIGS. 4, 10-13, and 15-18, of the at least one free-standing tunnel module 120, thereby vertically enclosing the at least one free-standing tunnel module 120. At least one horizontal ceiling panel 116 secures to an exterior ceiling area of the at least one free-standing tunnel module 120. At least one horizontal floor panel 114 is included, whereby the at least one horizontal ceiling panel 116 and the at least one floor panel 114 horizontally enclose the at least one free-standing tunnel module 120. In some embodiments, the ceiling and wall panels secure to the exterior of the tunnel structure, while in other embodiments, the ceiling and wall panels secure the interior of the tunnel structure.

In some embodiments of the temporary protective structural system 100 a plurality of said free-standing tunnel modules 120 are placed end to end to form an elongate modular tunnel system, as shown in FIGS. 3-5, and 19. As may be appreciated specifically in FIG. 19, the modules 120 may be placed on stairs 14, with a floor sheet 114 modified to fit the stairs 14 snuggly. The modules 120 may pivotally connect at a top plate of the next module 120. Wall sheets may be cut to size to create an enclosed module. Further, the modules 120 may also be curved using intermediate noggins 108*b*. Similarly, ceiling panels may be cut to fit the new curved shape.

In some embodiments of the temporary protective structural system 100, footings 134 are placed under each stud 104 in the pair of opposing studs 104*a*/104*b* of the frame members 102/102*a*/102*b*, thereby structurally bracing said free-standing tunnel module 120, as shown in FIG. 6. The footings 134 may be constructed of the fluted material, and be folded along a fold line 136, whereby a surface to one side of the fold line 136 rests on the floor 10, and a surface on the other side of the fold line 136 braces the frame 102.

In some embodiments of the temporary protective structural system 100, a screwless securement between the top plates 106 and the ceiling joists 110 are used, as may be appreciated in FIGS. 4-8, whereby the different members 106/110 each fit together to help support one another without a fixed connection point. In these embodiments, each top plate 106 includes at least one vertical notch 126 with an upper opening 144, as shown in FIG. 8. Each ceiling joist 110 includes a vertical notch 132 at each distal end, wherein each vertical notch 132 has a lower opening 148, as shown in FIG. 7. The at least one vertical notch 126 of each of the top plates 106 is configured for complemental engagement with the vertical notch 132 in the ceiling joist 110, whereby the at least a first frame member 102*a* and the at least a second frame member 102*b* are thereby connected when each of the lower openings 148 of the vertical notches 132 of the ceiling joist 110 are slid down complemental notches 126 with upper openings 140 of said top plate 106. This engagement may be appreciated in FIGS. 2-6.

In some embodiments of the temporary protective structural system 100, a screwless securement between the noggins 108 and the studs 104 are used, whereby the different members 108/104/104*a*/104*b* each fit together to help support one another without a fixed connection point. In these embodiments, each stud 104 includes at least one horizontal notch 128 with an outer opening 146, as shown in FIG. 8. Each nogging 108 includes a horizontal notch 130 at each distal end, wherein each notch 130 has an inner opening 144, as may be seen in FIG. 7. The at least one horizontal notch 128 of each of the studs 104 is configured for complemental engagement with the horizontal notch 130 in the nogging 108, whereby the at least a first frame member 102*a* and the at least a second frame 102*b* member are thereby connected when each of the inner openings 144 of the horizontal notches 130 of the noggings are slid into complemental horizontal notches 128 with outer openings 146 of the studs. This engagement may be appreciated in FIGS. 2-8.

In some embodiments a screwless securement between the noggins 108 and the studs 104 similar to the securement above are used, however, in this embodiment, the notches are inverse of the above embodiment. While the exact arrangement may not be shown in the drawings, the nogging remains the same, and the stud 104 merely includes notches opening from an inner portion rather than an outer portion. Each stud 104 includes at least one horizontal notch 128 with an inner opening. Each nogging 108 includes a horizontal notch 130 at each distal end, wherein each notch 130 has an outer opening 144. At least one horizontal notch 128 of each of the studs 104 is configured for complemental engagement with the horizontal notch 130 in the nogging 108, whereby the at least a first frame member 102*a* and the at least a second frame member 102*b* are thereby connected when each of the outer openings of the horizontal notches 130 of the noggings 108 are slid into complemental horizontal notches 128 with inner openings of the studs 104.

In some embodiments of the temporary protective structural system 100, a geometry of each nogging 108 is identical to a geometry of each ceiling joist 110 to provide for simplicity and interchangeability.

In some embodiments of the temporary protective structural system 100, the ceiling panels 116, wall panels 112, and floor panels 114 are constructed of a corrugated or fluted material 156 thereby configuring the ceiling panels 116, wall panels 112, and floor panels 114 for cushion against impacting objects. In some embodiments, the ceiling joists 110, noggings 108, and frame members 102 are all constructed of the corrugated or fluted material 156. The corrugated or fluted material 156 may be made of a fluted plastic sheet.

In some embodiments an adhesive tape 160 seals seams between panels 112/114/116, including seams existing between one or more of the ceiling panels 116, wall panels 112, and floor panels 114 when multiple panels are incorporated, and the tape 160 seals seams between the free-standing tunnel modules 120 when multiple free-standing tunnel modules 120 are incorporated.

In some embodiments of the temporary protective structural system 100, the system further includes a plurality of the protection panels 112/114/116 that are included with an adhesive area 162 for attaching the protection panels 112/114/116 to surfaces outside of the free-standing tunnel module 120, as shown in FIG. 4, or inside the free-standing tunnel module 120. This helps with protection in larger areas that are not contained within the area of the inside of the free-standing tunnel module 120.

In some embodiments of the temporary protective structural system 100, geometries of each of the protection panels 112/114/116, wall panels 112, ceiling panels 116, and floor panels 114 are identical in geometry to provide for simplicity and interchangeability. In some embodiments, the wall panels 112 also include a fold line 111 to allow the wall panels 112 to provide a wrapping effect for securement. In some embodiments, the ceiling panels 116 also include a fold line 138 to allow the ceiling panels 116 to provide a wrapping effect for securement around the outside of the tunnel module 120.

In some embodiments of the temporary protective structural system 100, the system further includes a plurality of foldable protection panels 118 with an adhesive area 162 for attaching the protection panels to surfaces of stairs. In some embodiments, each foldable protection panel 118 in the plurality of foldable protection panels has a gripping element 122 adhesively affixed to an upper surface of the each foldable protective panel 118 to provide traction, as shown in FIG. 1.

In some embodiments of the temporary protective structural system 100, the system 100 further includes a plurality of structural fasteners 180/184 configured to secure the noggins 108 or the ceiling joists 110 to additional noggins 108 or ceiling joists 110 in a plurality of noggins 108 or ceiling joists 110. In some embodiments, the plurality of structural fasteners are pegs 180 configured to secure the noggins 108 to additional noggins 108 to provide for horizontally angulated tunnel systems, as shown conceptually in FIG. 3, wherein the pegs 180 connect anchor apertures 182 in distal ends of the noggins 108 to anchor apertures 182 in distal ends of the additional noggins 108. In some embodiments, the plurality of structural fasteners are pegs 180 configured to secure the ceiling joists 110 to additional ceiling joists 110 to provide for vertically angulated tunnel systems, as shown in FIG. 19, wherein the pegs 180 connect anchor apertures 182 in distal ends of the ceiling joists 110 to anchor apertures 182 in distal ends of the additional ceiling joists 110. Further, anchor apertures 182 may be included in stud members 104, top plates 106, and panels 112/114/116, for securement by the pegs 180. Some of these structural fasteners 180/184 may be seen in FIGS. 9-18.

Figure 10:
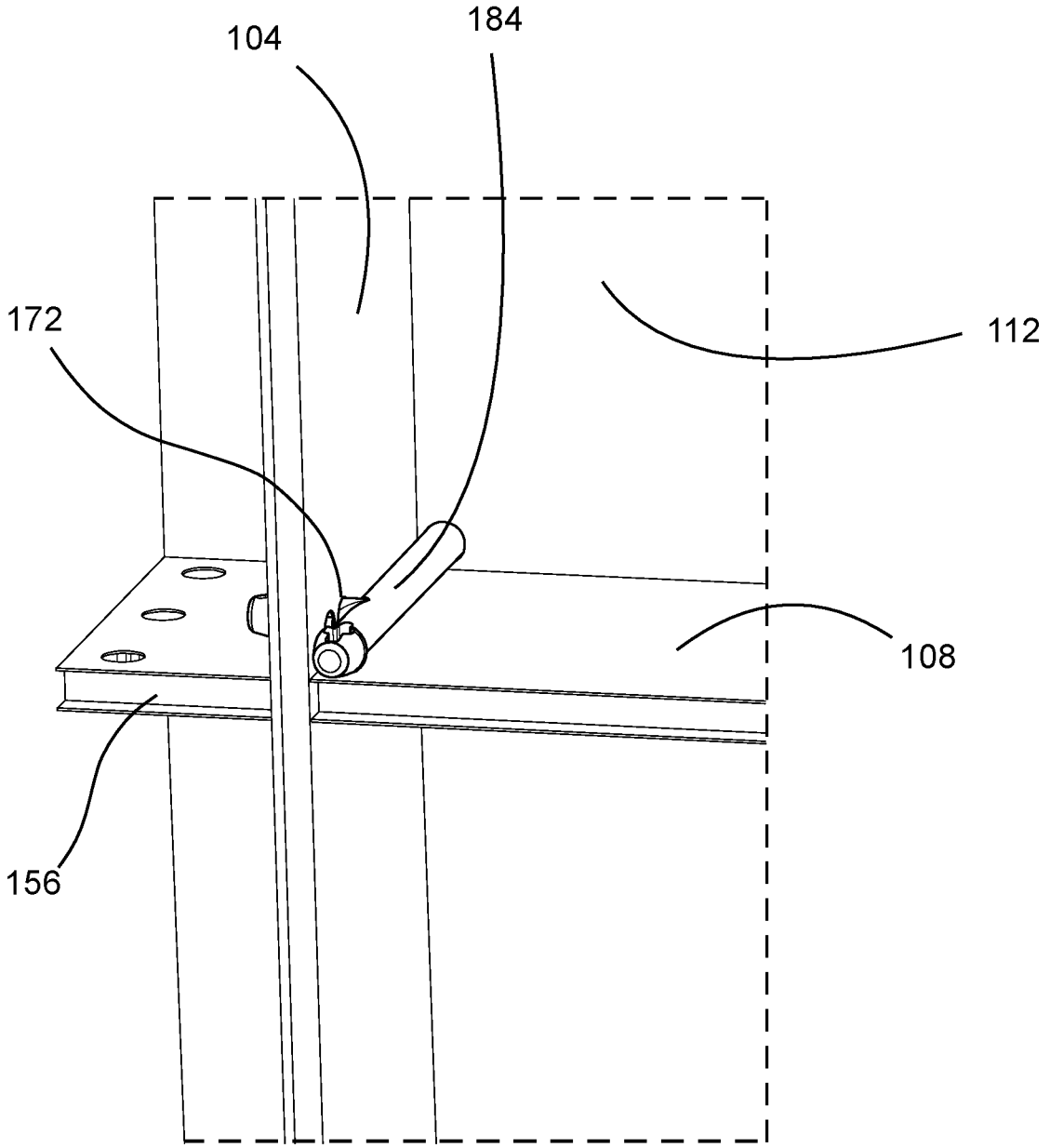
FIGS. 10-13 illustrate various isometric views of the engagement of the securement anchor.

In some embodiments of the temporary protective structural system 100, the system further includes a plurality of structural fasteners 184 configured to secure the noggins 108 or the ceiling joists 110 to the studs 104. In some embodiments, the plurality of structural fasteners 184 are configured to secure the noggins 108 or the ceiling joists 110 to the studs 114. The structural fasteners comprise an elongate anchor body 174 having an engagement cap 172 at a proximal end and an engagement hook 168 at a distal end, and an engagement stem 170 protruding from the anchor body 174 in a direction perpendicular to an axis on which the engagement hook 168 and the engagement cap 172. The engagement hook 168 is configured to engage with one of the nogging 108, as shown in FIG. 10, the ceiling joist 110, the wall panel 112, as seen in FIGS. 10-12, and the ceiling panel 116, whereby the engagement hook 168 extends through an aperture 182, as shown in FIG. 11, or around a side of the ceiling joist 110 or the nogging 108, as shown in FIG. 12, thereby bracing the anchor body 174 against the noggins 108 or ceiling joists 110 and the studs 104. The engagement cap 172 is configured to engage with the wall panel 112, as shown in FIG. 13, or the ceiling panel 116, whereby the engagement cap 172 may extend through an aperture 182 in the wall panel 112 or the ceiling pane 1161. The engagement stem 170 is configured to engage with the studs 104, whereby the engagement step 170 extends through an aperture 182 in the stud 104. The apertures in the system, including joist apertures 153, nogging apertures 154, stud apertures 158, top plate apertures 164, and panel apertures 166, are all configured to the same dimensions so that the peg stems 176, anchor hooks 168, anchor engagement stems 170, and anchor engagement caps 172 can all fit through the same hole for a uniform construction and application.

In some embodiments, the engagement stem 170 and the engagement cap 172 of the anchor body 174 terminate in a frustoconical nub, as may be seen in FIG. 9, whereby the frustoconical shape allows a distal end, with a circumference smaller than that of said aperture, to slide into said aperture and a proximal end, with a circumference larger than that of said aperture, to poke through and anchor said structural fastener, as may be appreciated in FIGS. 11 and 13.

While the anchor system is shown in FIGS. 9-13 as a cylindrical embodiment, the primary elements are the hook element, the stem element, and the cap element. The hook may be in an equivalent configuration, so long as it accomplishes the function of gripping onto a surface without extending through the surface. The engagement stem secures the anchor to the stud, or other surface, by extending through the surface. It is not necessary that the engagement stem be cylindrical, and may even take the form of a linear protrusion with a lip, or structure with equivalent function. Lastly, the engagement cap is intended to secure the anchor perpendicular to the engagement stem, and the geometric shapes can vary so long as the alternative is functionally equivalent.

Some embodiments of the structural fasteners resemble a U-shaped fastener with a center channel for containing the stud, an apex with a stopper lip, and a pair of hooks at an inner end of each leg of the U-shaped fastener, wherein the pair of hooks are configured for a geometry to snugly receive a sidewall of the nogging or ceiling joist member. In some embodiments, the apex of the U-shaped fastener includes a protruding neck with a circumferential lip for complemental insertion and securement through an anchor aperture located within a wall panel. In some embodiments, the plurality of structural fasteners configured to secure the noggins or the ceiling joists to the studs comprise a linear horizontal platform with a perpendicularly facing protruding neck with a circumferential lip for complemental insertion and securement through an anchor aperture located within a stud at a first end, and a vertical lip configured for engagement into a slot of a wall panel at an opposite end.

In another exemplary embodiment, a temporary protective structural system 100 with adjustable width is provided, as shown in FIGS. 17-19. The temporary protective structural system 100 with adjustable width includes a plurality of frame members 102 having at least a first frame **102*a* member and second frame member 102*b*, wherein each frame member in the plurality of frame members is comprised of an adjustable frame element 150 including a pair of opposing studs and integrated two-part top plate 152 connecting the pair of opposing studs 104*a*/104*b* at an upper integration point 104*c*. The temporary protective structural system 100 with adjustable width further includes a plurality of noggings 108 connecting a first stud 104*a* of the pair of opposing studs 104*a*/104*b* of the first frame member 102*a* in the plurality of frame members 102*a*/102*b* with a first stud 104*a* of the pair of opposing studs 104*a*/104*b* of the second frame member 102*b* in the plurality of frame members 102*a*/102*b*, and a plurality of noggings 108 connecting a second stud 104*b* of the pair of opposing studs 104*a*/104*b* of the first frame member 102*a* in the plurality of frame members 102*a*/102*b* with a second stud 104*b* of the pair of opposing studs 104*a*/104*b* of the second frame member 102*b* in the plurality of frame members 102*a*/102*b*, thereby forming at least one free-standing tunnel module 120. The temporary protective structural system 100 with adjustable width further includes a plurality of ceiling joists 110 connecting the two-part top plate 152 of each of the first frame members 102***a* to a two-part top plate 152 of each of the second frame members 102*b*, thereby securing the at least one free-standing tunnel module 120. The temporary protective structural system 100 with adjustable width further includes at least one vertical wall panel 112 secured to an exterior area of the at least one free-standing tunnel module 120, thereby vertically enclosing the at least one free-standing tunnel module 120. The temporary protective structural system 100 with adjustable width further includes at least one horizontal ceiling panel 116 secured to an exterior ceiling area of the at least one free-standing tunnel module 120, and at least one horizontal floor panel 114, whereby the at least one horizontal ceiling panel 116 and the at least one floor panel 114 horizontally enclose the at least one free-standing tunnel module 120.

In another exemplary embodiment, a method of providing surface protection during at least construction and demolition is disclosed. The method of providing surface protection during at least construction and demolition comprises providing at least one horizontal floor panel 114, securing the at least one horizontal floor panel 114 to a floor 10, providing a plurality of frame members 102 including at least a first frame member 102*a* and at least a second frame member 102*b*, whereby the providing of the plurality of frame members further includes implementing a unitary frame construction comprising a pair of opposing studs 104*a*/104*b* and integrating a top plate 106 connecting the pair of opposing studs 104*a*/104*b* at an upper integration point 102*c*. The method of providing surface protection during at least construction and demolition further comprises providing a plurality of noggings 108 and configuring the plurality of noggins 108 to form at least one free-standing tunnel module 120 when in combination with the plurality of frame members 102. The method of providing surface protection during at least construction and demolition further includes securing the at least one free-standing tunnel module 120 by providing a plurality of ceiling joists 110, whereby the securing of the at least one free-standing tunnel module 120 further comprises connecting the top plate 106 of each of the first frame members 102*a* to a top plate 106 of each of the second frame members 102*b*, thereby securing the at least one free-standing tunnel module 120. The method of providing surface protection during at least construction and demolition further includes enclosing the at least one free-standing tunnel module 120 by providing at least one vertical wall panel 112 and securing the at least one vertical wall panel 112 to the at least one free-standing tunnel module 120, thereby vertically enclosing the at least one free-standing tunnel module 120, and securing at least one horizontal ceiling panel 116 to a ceiling area of the at least one free-standing tunnel module 120.

In some embodiments of the method of providing surface protection during at least construction and demolition, the step of configuring the plurality of noggins 108 to form at least one free-standing tunnel module 120 and the providing the plurality of noggings 108 further includes connecting a first stud 104*a* of the pair of opposing studs 104*a*/104*b* of the first frame member 102*a* in the plurality of frame members 102*a*/102*b* with a first stud 104*a* of the pair of opposing studs 104*a*/104*b* of the second frame member 102*b* in the plurality of frame members 102*a*/102*b*, and connecting a second stud 104*b* of the pair of opposing studs 104*a*/104*b* of the first frame member 102*a* in the plurality of frame members 102*a*/102*b* with a second stud 104*b* of the pair of opposing studs 104*a*/104*b* of the second frame member 102*b* in the plurality of frame members 102*a*/102*b*, thereby forming the at least one free-standing tunnel module 120.

In some embodiments, the method of providing surface protection during at least construction and demolition further includes placing the plurality of the free-standing tunnel modules 120 end to end to form an elongate modular tunnel system, as shown in FIGS. 2-5.

In some embodiments, the method further includes configuring of the tunnel modules 120 for dust-free containment by sealing and connection points within each tunnel module 120 in the plurality of tunnel modules 120 by applying adhesive tape 160 to the seams and connection points, and sealing seams and connection points between each of the plurality of free-standing tunnel modules 120 by applying adhesive tape 160 to the seams and connection point. The connection points within each tunnel module 120 would include spaces between the floor 114 and the wall panels 112, as well as between the wall panels 112 and the ceiling panels 116, while connection points between modules would involve spaces between adjacent wall panels 112, adjacent ceiling panels 116, adjacent floor panels 114, and the like.

In some embodiments, the method of providing surface protection during at least construction and demolition further includes configuring a screwless securement between each stud in the pair of opposing studs 104*a*/104*b* and each noggin 108 in the plurality of noggins 108 by incorporating at least a pair of notches 128 into each stud 104*a*/104*b* and at least a pair of notches 130 into each noggin 108 for complemental engagement between the noggins 108 and each stud 104/104*a*/104*b*, whereby once slid together the studs 104*a*/104*b* and the noggins 108 support one another forming a non-fixed structural support, as may be appreciated in FIGS. 3 and 4.

In some embodiments, the method of providing surface protection during at least construction and demolition further includes configuring a screwless securement between the top plate 106 and each ceiling joist 110 in the plurality of ceiling joists 110 by incorporating at least a pair of notches 126 into the top plate 106 and at least a pair of notches 132 into each ceiling joist 110 for complemental engagement between the ceiling joists 110 and the top plate 106, as may be appreciated in FIGS. 3 and 4, whereby once slid together the ceiling joists 110 and the top plates 106 support one another forming a non-fixed structural support.

In some embodiments, the method of providing surface protection during at least construction and demolition further includes configuring the noggins 108 and the ceiling joists 110 for interchangeability by implementing an identical geometry of the noggins 108 and the ceiling joists 110, as may be appreciated in FIG. 7.

In some embodiments, the method of providing surface protection during at least construction and demolition further includes configuring each horizontal floor panel 114, each frame member 102, each nogging 108, each ceiling joist 110, each vertical wall panel 112, and each horizontal ceiling panel 116 for structural righty and cushion-ability by implementing a fluted plastic material 156.

In some embodiments, the method of providing surface protection during at least construction and demolition further includes providing a plurality of anchor apertures 182 in each horizontal floor panel 114, each frame member 102, each nogging 108, each ceiling joist 110, each vertical wall panel 112, and each horizontal ceiling panels 116, wherein each horizontal floor panel 114, each frame member 102, each nogging 108, each ceiling joist 116, each vertical wall panel 112, and each horizontal ceiling panel 116 each have at least a pair of anchor apertures 182 therein. The embodiment also includes providing a plurality of securement pegs 180, as shown in FIGS. 9-18. Each anchor aperture 182 in the plurality of anchor apertures 182 is configured to receive a peg 180 of the plurality of pegs 180 to provide a non-fixed structural connection between complemental components 102/108/110/112/114/116.

In some embodiments, the method of providing surface protection during at least construction and demolition further includes providing a plurality of anchor apertures 182 in each horizontal floor panel 114, each frame member 102, each nogging 108, each ceiling joist 110, each vertical wall panel 112, and each horizontal ceiling panels 116. Each horizontal floor panel 114, each frame member 102, each nogging 108, each ceiling joist 110, each vertical wall panel 112, and each horizontal ceiling panels 116 each have at least a pair of anchor apertures 182 therein. This embodiment further includes providing a plurality of securement anchors 184. Each anchor aperture 182 in the plurality of anchor apertures 182 is configured to engage with a securement anchor 184 of the plurality of securement anchors 184 to provide a non-fixed structural connection between complemental components.

In some embodiments of the method of providing surface protection during at least construction and demolition, the anchors are specifically configured to secure the different components, but still be versatile enough to be used in different arrangements. To accomplish this, the structural fasteners comprise an elongate anchor body 174 having an engagement cap 172 at a proximal end and an engagement hook 168 at a distal end, and an engagement stem 170 protruding from the anchor body 174 in a direction perpendicular to an axis on which the engagement hook 168 and the engagement cap 172. The engagement hook 168 is configured to engage with one of the nogging 108, as shown in FIG. 10, the ceiling joist 110, the wall panel 112, as seen in FIGS. 10-12, and the ceiling panel 116, whereby the engagement hook 168 extends through an aperture 182, as shown in FIG. 11, or around a side of the ceiling joist 110 or the nogging 108, as shown in FIG. 12, thereby bracing the anchor body 174 against the noggins 108 or ceiling joists 110 and the studs 104. The engagement cap 172 is configured to engage with the wall panel 112, as shown in FIG. 13, or the ceiling panel 116, whereby the engagement cap 172 may extend through an aperture 182 in the wall panel 112 or the ceiling pane 1161. The engagement stem 170 is configured to engage with the studs 104, whereby the engagement step 170 extends through an aperture 182 in the stud 104. The apertures in the system, including joist apertures 153, nogging apertures 154, stud apertures 158, top plate apertures 164, and panel apertures 166, are all configured to the same dimensions so that the peg stems 176, anchor hooks 168, anchor engagement stems 170, and anchor engagement caps 172 can all fit through the same hole for a uniform construction and application.

To provide a removable securement, the engagement stem 170 and the engagement cap 172 of the anchor body 174 terminate in a frustoconical nub, as may be seen in FIG. 9, whereby the frustoconical shape allows a distal end, with a circumference smaller than that of said aperture, to slide into said aperture and a proximal end, with a circumference larger than that of said aperture, to poke through and anchor said structural fastener, as may be appreciated in FIGS. 11 and 13.

While there has been shown and described above the preferred embodiment of the instant invention it is to be appreciated that the invention may be embodied otherwise than is herein specifically shown and described and that certain changes may be made in the form and arrangement of the parts without departing from the underlying ideas or principles of this invention as set forth in the Claims appended herewith.

I claim:

1. A temporary protective structural system with adjustable width, comprising:

a plurality of frame members including a plurality of first frame members and a plurality of second frame members, wherein each said frame member is comprised of an adjustable frame element including a pair of opposing studs and integrated two-part top plate connecting said pair of opposing studs at an upper integration point;

a plurality of first noggings connecting a respective first stud of said pair of opposing studs of each said first frame member with a respective first stud of said pair of opposing studs of each said second frame member, and a plurality of second noggings connecting a respective second stud of said pair of opposing studs of each said first frame member with a respective second stud of said pair of opposing studs of each said second frame member, thereby defining at least one free-standing tunnel module;

a plurality of ceiling joists connecting said two-part top plate of each of said first frame members to a respective said two-part top plate of each of said second frame members, thereby securing said at least one free-standing tunnel module;

at least one vertical wall panel secured to an exterior wall area of said at least one free-standing tunnel module, thereby vertically enclosing said at least one free-standing tunnel module;

at least one horizontal ceiling panel secured to an exterior ceiling area of said at least one free-standing tunnel module; and at least one horizontal floor panel positioned over an existing floor surface, wherein said at least one horizontal ceiling panel and said at least one horizontal floor panel horizontally enclose said at least one free-standing tunnel module.

2. A temporary protective structural system, comprising:

a plurality of frame members including a plurality of first frame members and a plurality of second frame members, wherein each said frame member is a unitary frame element comprising a pair of opposing studs and integrated top plate connecting said pair of opposing studs at an upper integration point;

a plurality of first noggings connecting a respective first stud of said pair of opposing studs of each said first frame member with a respective first stud of said pair of opposing studs of each said second frame member, and a plurality of second noggings connecting a respective second stud of said pair of opposing studs of each said first frame member with a respective second stud of said pair of opposing studs of each said second frame member, thereby defining at least one free-standing tunnel module;

a plurality of ceiling joists connecting said top plate of each of said first frame members to a respective said top plate of each of said second frame members, thereby securing said at least one free-standing tunnel module;

at least one vertical wall panel secured to an exterior wall area of said at least one free-standing tunnel module, thereby vertically enclosing said at least one free-standing tunnel module;

at least one horizontal ceiling panel secured to an exterior ceiling area of said at least one free-standing tunnel module; and at least one horizontal floor panel positioned over an existing floor surface, wherein said at least one horizontal ceiling panel and said at least one horizontal floor panel horizontally enclose said at least one free-standing tunnel module.

3. The temporary protective structural system as recited in claim 2, wherein a plurality of said free-standing tunnel modules are placed end to end to form an elongate modular tunnel system.

4. The temporary protective structural system as recited in claim 2, further comprising:

footings under each stud in said pair of opposing studs of said each of said frame members, thereby structurally bracing said free-standing tunnel module.

5. The temporary protective structural system as recited in claim 2, further comprising:

each said top plate includes at least one vertical notch with an upper opening;

each said ceiling joist includes a vertical notch at each distal end, wherein each vertical notch has a lower opening; and said at least one vertical notch of each of said top plates is configured for complemental engagement with said vertical notch in said ceiling joist, whereby said first frame members and said second frame members are thereby connected when each of said lower openings of said vertical notches of said ceiling joist are slid down complemental notches with upper openings of said top plate.

6. The temporary protective structural system as recited in claim 2, further comprising:

each said stud includes at least one horizontal notch with an outer opening;

each said nogging includes a horizontal notch at each distal end, wherein each notch has an inner opening; and said at least one horizontal notch of each of said studs is configured for complemental engagement with said horizontal notch in each said nogging, whereby said first frame members and said second frame members are thereby connected when each of said inner openings of said horizontal notches of said noggings are slid into complemental horizontal notches with outer openings of said studs.

7. The temporary protective structural system as recited in claim 2, further comprising:

each said stud includes at least one horizontal notch with an inner opening;

each said nogging includes a horizontal notch at each distal end, wherein each notch has an outer opening; and said at least one horizontal notch of each of said studs is configured for complemental engagement with said horizontal notch in each said nogging, whereby said first frame members and said second frame members are thereby connected when each of said outer openings of said horizontal notches of said noggings are slid into complemental horizontal notches with inner openings of said studs.

8. The temporary protective structural system as recited in claim 2, wherein a geometry of each nogging is identical to a geometry of each said ceiling joist to provide for simplicity and interchangeability.

9. The temporary protective structural system as recited in claim 2, wherein an adhesive tape seals seams between panels, including seams existing between one or more of said ceiling panels, said wall panels, and said floor panels when multiple panels are incorporated, and said tape seals seams between said free-standing tunnel modules when multiple free-standing tunnel modules are incorporated.

10. The temporary protective structural system as recited in claim 2, wherein said ceiling panels, said wall panels, and said floor panels are constructed of a corrugated or fluted material thereby configuring said ceiling panels, said wall panels, and said floor panels for cushion against impacting objects.

11. The temporary protective structural system as recited in claim 10, wherein the corrugated or fluted material is a fluted plastic sheet.

12. The temporary protective structural system as recited in claim 2, wherein said ceiling joists, said noggings, and said frame members are constructed of a corrugated or fluted material thereby configuring said ceiling joists, said noggings, and said frame members for cushion against impacting objects and structural strength.

13. The temporary protective structural system as recited in claim 12, wherein the corrugated or fluted material is a fluted plastic sheet.

14. The temporary protective structural system as recited in claim 2, further comprising:

a plurality of protection panels with an adhesive area for attaching said protection panels to surfaces outside of said free-standing tunnel module for protection in larger areas that are not contained within an area of inside of said free-standing tunnel module.

15. The temporary protective structural system as recited in claim 14, wherein geometries of each of said protection panels, said wall panels, said ceiling panels, and said floor panels are identical to provide for simplicity and interchangeability.

16. The temporary protective structural system as recited in claim 2, further comprising:

a plurality of foldable protection panels with an adhesive area for attaching said protection panels to surfaces of stairs.

17. The temporary protective structural system as recited in claim 16, further comprising:

each foldable protection panel in said plurality of foldable protection panels having a gripping element adhesively affixed to an upper surface of said each foldable protective panel to provide traction.

18. The temporary protective structural system as recited in claim 2, further comprising:

a plurality of structural fasteners configured to secure said noggings or said ceiling joists to additional noggings or said ceiling joists in a respective said plurality of noggings or said ceiling joists.

19. The temporary protective structural system as recited in claim 18, wherein said plurality of structural fasteners are pegs configured to secure said respective noggings to said additional noggings to provide for horizontally angulated tunnel systems, wherein said pegs connect anchor apertures in distal ends of said respective noggings to anchor apertures in distal ends of said additional noggings.

20. The temporary protective structural system as recited in claim 18, wherein said plurality of structural fasteners are pegs configured to secure said ceiling joists to additional ceiling joists to provide for vertically angulated tunnel systems, wherein said pegs connect anchor apertures in distal ends of said ceiling joists to anchor apertures in distal ends of said additional ceiling joists.

21. The temporary protective structural system as recited in claim 2, further comprising:

a plurality of structural fasteners configured to secure said noggings or said ceiling joists to said studs.

22. The temporary protective structural system as recited in claim 21, wherein said plurality of structural fasteners configured to secure said noggings or said ceiling joists to said studs comprise:

an elongate anchor body having an engagement cap at a proximal end and an engagement hook at a distal end, and an engagement stem protruding from said anchor body in a direction perpendicular to an axis on which said engagement hook and said engagement cap;

wherein said engagement hook is configured to engage with one of a respective said nogging, a respective said ceiling joist, a respective said wall panel, and a respective said ceiling panel, whereby said engagement hook extends through an aperture or around a side of the respective ceiling joist or the respective nogging, thereby bracing said anchor body against said noggings or ceiling joists and said studs;

wherein said engagement cap is configured to engage with the respective wall panel or the respective ceiling panel, whereby said engagement cap extends through an aperture in the respective wall panel or the respective ceiling panel; and wherein said engagement stem is configured to engage with said studs, whereby said engagement stem extends through a respective aperture in a respective said stud.

23. The temporary protective structural system as recited in claim 22, wherein said engagement stem and said engagement cap terminate in a frustoconical nub, whereby said frustoconical nub allows a distal end thereof, with a circumference smaller than that of said respective aperture, to slide into said respective aperture and a proximal end, with a circumference larger than that of said respective aperture, to poke through and anchor a respective said structural fastener.

24. A method of providing surface protection during at least construction and demolition, comprising:

providing at least one horizontal floor panel;

securing said at least one horizontal floor panel to an existing floor;

providing a plurality of frame members including a plurality of first frame members and a plurality of second frame members, whereby said providing of said plurality of frame members further includes implementing a unitary frame construction comprising a pair of opposing studs and integrating a top plate connecting said pair of opposing studs at an upper integration point;

providing a plurality of first and second noggings and configuring said plurality of first and second noggings such that said first noggings connect a respective first stud of said pair of opposing studs of each said first frame member with a respective first stud of said pair of opposing studs of each said second frame member, and said second noggings connect a respective second stud of said pair of opposing studs of each said first frame member with a respective second stud of said pair of opposing studs of each said second frame member, thereby defining at least one free-standing tunnel module;

securing said at least one free-standing tunnel module by providing a plurality of ceiling joists, whereby said securing said at least one free-standing tunnel module further includes connecting said top plate of each of said first frame members to a respective said top plate of each of said second frame members, thereby securing said at least one free-standing tunnel module;

enclosing said at least one free-standing tunnel module by providing at least one vertical wall panel and securing said at least one vertical wall panel to a wall area of said at least one free-standing tunnel module, thereby vertically enclosing said at least one free-standing tunnel module; and securing at least one horizontal ceiling panel to a ceiling area of said at least one free-standing tunnel module, wherein said at least one horizontal ceiling panel and said at least one horizontal floor panel horizontally enclose said at least one free-standing tunnel module.

25. The method as recited in claim 24, further comprising:

configuring a screwless securement between each stud in said pair of opposing studs and each said nogging by incorporating at least a pair of notches into each said stud and at least a pair of notches into each said nogging for complemental engagement between said noggings and each said stud, whereby once slid together said studs and said noggings support one another forming a non-fixed structural support.

26. The method as recited in claim 24, further comprising:

configuring a screwless securement between each said top plate and each said ceiling joist in said plurality of ceiling joists by incorporating at least a pair of notches into each said top plate and at least a pair of notches into said each ceiling joist for complemental engagement between said ceiling joists and said top plates, whereby once slid together each said ceiling joists and said top plates support one another forming a non-fixed structural support.

27. The method as recited in claim 24, further comprising:

configuring said noggings and said ceiling joists for interchangeability by implementing an identical geometry of said noggings and said ceiling joists.

28. The method as recited in claim 24, further comprising:

configuring each said horizontal floor panel, each said frame member, each said nogging, each said ceiling joist, each said vertical wall panel, and each said horizontal ceiling panel for structural rigidity and cushion-ability by implementing a fluted plastic material.

29. The method as recited in claim 24, further comprising:

including a plurality of anchor apertures in each said horizontal floor panel, each said frame member, each said nogging, each said ceiling joist, each said vertical wall panel, and each said horizontal ceiling panel, wherein each said horizontal floor panel, each said frame member, each said nogging, each said ceiling joist, each said vertical wall panel, and each said horizontal ceiling panel each have at least a pair of anchor apertures therein;

providing a plurality of pegs; and wherein each anchor aperture in said plurality of anchor apertures is configured to receive a respective said peg of said plurality of pegs to provide a non-fixed structural connection between complemental components.

30. The method as recited in claim 24, further comprising:

placing said plurality of said free-standing tunnel modules end to end to form an elongate modular tunnel system.

31. The method as recited in claim 30, further comprising:

configuring said tunnel modules for dust-free containment by:

sealing seams and connection points within each tunnel module in said plurality of tunnel modules by applying adhesive tape to said seams and connection points; and sealing seams and connection points between each of said plurality of free-standing tunnel modules by applying adhesive tape to said seams and connection point.

32. The method as recited in claim 24, further comprising:

including a plurality of anchor apertures in each said horizontal floor panel, each said frame member, each said nogging, each said ceiling joist, each said vertical wall panel, and each said horizontal ceiling panel, wherein each said horizontal floor panel, each said frame member, each said nogging, each said ceiling joist, each said vertical wall panel, and each said horizontal ceiling panel each have at least a pair of anchor apertures therein; and providing a plurality of securement anchors; and wherein each anchor aperture in said plurality of anchor apertures is configured to engage with a respective said securement anchor of said plurality of securement anchors to provide a non-fixed structural connection between complemental components.

33. The method as recited in claim 32, wherein each anchor in said plurality of anchors comprises a structural fastener for securing components, including said frame members, said ceiling joists, said noggings, said vertical wall panels, and said ceiling panels, wherein said structural fastener comprises:

an elongate anchor body having an engagement cap at a proximal end and an engagement hook at a distal end, and an engagement stem protruding from said anchor body in a direction perpendicular to an axis on which said engagement hook and said engagement cap;

wherein said engagement hook is configured to engage with one of a respective said nogging, a respective said ceiling joist, a respective said wall panel, and a respective said ceiling panel, whereby said engagement hook extends through an aperture or around a side of the respective ceiling joist or the respective nogging, thereby bracing said anchor body against said noggings or ceiling joists and said studs;

wherein said engagement cap is configured to engage with the respective wall panel or the respective ceiling panel, whereby said engagement cap extends through an aperture in the respective wall panel or the respective ceiling panel; and wherein said engagement stem is configured to engage with said studs, whereby said engagement stem extends through a respective aperture in a respective said stud.

34. The method as recited in claim 33, wherein said engagement stem and said engagement cap terminate in a frustoconical nub, whereby said frustoconical nub allows a distal end thereof, with a circumference smaller than that of said respective aperture, to slide into said respective aperture and a proximal end, with a circumference larger than that of said respective aperture, to poke through and anchor a respective said structural fastener.

* * * * *